US011701755B2

(12) United States Patent
Chen et al.

(10) Patent No.: US 11,701,755 B2
(45) Date of Patent: Jul. 18, 2023

(54) ABRASIVE ARTICLES INCLUDING A SATURANT AND AN ANTI-LOADING SIZE LAYER

(71) Applicant: 3M INNOVATIVE PROPERTIES COMPANY, St. Paul, MN (US)

(72) Inventors: Jing Chen, Newark, CA (US); Lan Hong Liu, Rosemount, MN (US); Thomas P. Klun, Lakeland, MN (US); Thomas W. Floyd, St. Paul, MN (US); Bathsheba E. Chong Conklin, St. Paul, MN (US); Dong Wu, Shanghai (CN); Zhongmin Wang, Shanghai (CN)

(73) Assignee: 3M Innovative Properties Company, St. Paul, MN (US)

( * ) Notice: Subject to any disclaimer, the term of this patent is extended or adjusted under 35 U.S.C. 154(b) by 436 days.

(21) Appl. No.: 16/955,678

(22) PCT Filed: Dec. 19, 2018

(86) PCT No.: PCT/CN2018/121974
§ 371 (c)(1),
(2) Date: Jun. 18, 2020

(87) PCT Pub. No.: WO2019/120211
PCT Pub. Date: Jun. 27, 2019

(65) Prior Publication Data

US 2021/0069865 A1 Mar. 11, 2021

Related U.S. Application Data

(60) Provisional application No. 62/698,729, filed on Jul. 16, 2018, provisional application No. 62/608,350, filed on Dec. 20, 2017.

(51) Int. Cl.
*B24D 18/00* (2006.01)
*B24D 3/28* (2006.01)
(Continued)

(52) U.S. Cl.
CPC ..... *B24D 18/0072* (2013.01); *B24D 3/28* (2013.01); *B24D 3/346* (2013.01); *B24D 11/02* (2013.01)

(58) Field of Classification Search
None
See application file for complete search history.

(56) References Cited

U.S. PATENT DOCUMENTS 2,958,593 A 11/1960 Hoover
3,802,817 A 4/1974 Ki
(Continued)

FOREIGN PATENT DOCUMENTS

CN 101208385 6/2008
FR 2919513 A1 * 2/2009 ..... B24D 11/005
(Continued)

OTHER PUBLICATIONS

Davies, "The Separation of Airborne Dust and Particles", Institution of Mechanical Engineers, London Proceedings, IB, 1952, pp. 185-213.
(Continued)

*Primary Examiner* — Pegah Parvini
*Assistant Examiner* — Ross J Christie
(74) *Attorney, Agent, or Firm* — Ann K. Gallagher

(57) ABSTRACT

The present disclosure relates to saturated or primed abrasive article constructions containing an anti-loading composition which significantly reduces loading, is coatable, is durable, and is relatively inexpensive to manufacture. In particular, the use of the anti-loading compositions of the present disclosure as a size coat at least reduces if not eliminates the need for a supersize coat, while offering comparable if not superior performance and durability. The abrasive article further includes an anti-loading size layer
(Continued)

comprising a size coat binder and wax at least partially disposed on the abrasive layer.

16 Claims, 1 Drawing Sheet

(51) Int. Cl.
*B24D 3/34* (2006.01)
*B24D 11/02* (2006.01)

(56) References Cited

U.S. PATENT DOCUMENTS 4,227,350 A 10/1980 Fitzer
4,258,098 A 3/1981 Bondoc
4,314,827 A 2/1982 Leitheiser
4,396,403 A 8/1983 Ibrahim
4,518,397 A 5/1985 Leitheiser
4,560,612 A 12/1985 Yau
4,623,364 A 11/1986 Cottringer
4,640,810 A 2/1987 Laursen
4,652,274 A 3/1987 Boettcher
4,652,275 A 3/1987 Bloecher
4,744,802 A 5/1988 Schwabel
4,751,138 A 6/1988 Tumey
4,770,671 A 9/1988 Monroe
4,799,939 A 1/1989 Bloecher
4,881,951 A 11/1989 Wood
4,903,440 A 2/1990 Larson
4,917,764 A 4/1990 Lalwani
4,973,338 A 11/1990 Gaeta
4,991,362 A 2/1991 Heyer
5,011,508 A 4/1991 Wald
5,055,113 A 10/1991 Larson
5,078,753 A 1/1992 Broberg
5,090,968 A 2/1992 Pellow
5,114,787 A 5/1992 Chaplin
5,139,978 A 8/1992 Wood
5,164,265 A 11/1992 Stubbs
5,167,765 A 12/1992 Nielsen
5,201,916 A 4/1993 Berg
5,227,104 A 7/1993 Bauer
5,236,472 A 8/1993 Kirk
5,277,976 A 1/1994 Hogle
5,314,513 A 5/1994 Miller
5,334,648 A * 8/1994 Drews ..... C08L 61/24 525/154
5,366,523 A 11/1994 Rowenhorst
5,429,647 A 7/1995 Larmie
5,436,063 A 7/1995 Follett
5,486,219 A 1/1996 Ford
5,498,269 A 3/1996 Larmie
5,549,962 A 8/1996 Holmes
5,551,963 A 9/1996 Larmie
5,591,239 A 1/1997 Larson
5,595,828 A 1/1997 Weber
5,611,825 A * 3/1997 Engen ..... B24D 3/004 51/304
5,643,397 A 7/1997 Gorman
5,667,542 A 9/1997 Law
5,681,361 A 10/1997 Sanders, Jr.
5,704,952 A 1/1998 Law
5,712,210 A 1/1998 Windisch
5,858,140 A 1/1999 Berger
5,908,477 A * 6/1999 Harmer ..... B24D 18/00 51/306
5,928,070 A 7/1999 Lux
5,954,844 A 9/1999 Law
5,984,989 A 11/1999 Davison
6,017,831 A 1/2000 Beardsley
6,059,850 A 5/2000 Lise
6,086,648 A 7/2000 Rossetti, Jr
6,207,246 B1 3/2001 Moren
6,406,504 B1 6/2002 Lise
6,451,076 B1 9/2002 Nevoret
6,607,624 B2 8/2003 Berrigan
6,835,220 B2 12/2004 Swei
7,195,658 B2 3/2007 Swei
7,344,575 B2 3/2008 Thurber
7,985,269 B2 7/2011 Ludwig
8,142,531 B2 3/2012 Adefris
8,187,985 B2 5/2012 Rautray
8,252,076 B2 * 8/2012 Israelson ..... C09G 1/02 106/3
9,033,765 B2 5/2015 Woo
9,139,940 B2 9/2015 Berrigan
9,393,673 B2 7/2016 Eilers
9,446,502 B2 9/2016 Erickson
9,469,091 B2 10/2016 Henke
2002/0168508 A1 11/2002 Reed
2005/0085167 A1 4/2005 Swei
2005/0223649 A1 * 10/2005 O'Gary ..... B24D 11/02 51/294
2006/0016128 A1 1/2006 Oka
2015/0126098 A1 5/2015 Eilers
2015/0158148 A1 6/2015 Sharmila
2015/0306739 A1 10/2015 Vervacke
2016/0229032 A1 8/2016 Moren
2016/0354898 A1 12/2016 Nienaber
2017/0043450 A1 2/2017 Graham
2017/0129075 A1 5/2017 Thurber

FOREIGN PATENT DOCUMENTS

WO WO 1996-009141 3/1996
WO WO 1998-058769 12/1998
WO WO 2016-106020 6/2016
WO WO 2016-167967 10/2016
WO WO 2017-062482 4/2017
WO WO 2017-079513 5/2017
WO WO 2019-123335 6/2019

OTHER PUBLICATIONS

International Search Report for PCT International Application No. PCT/IB2018/060376, dated Apr. 25, 2019, 3 pages.
International Search Report for PCT International Application No. PCT/CN2018/121974, dated Mar. 27, 2019, 4 pages.

* cited by examiner

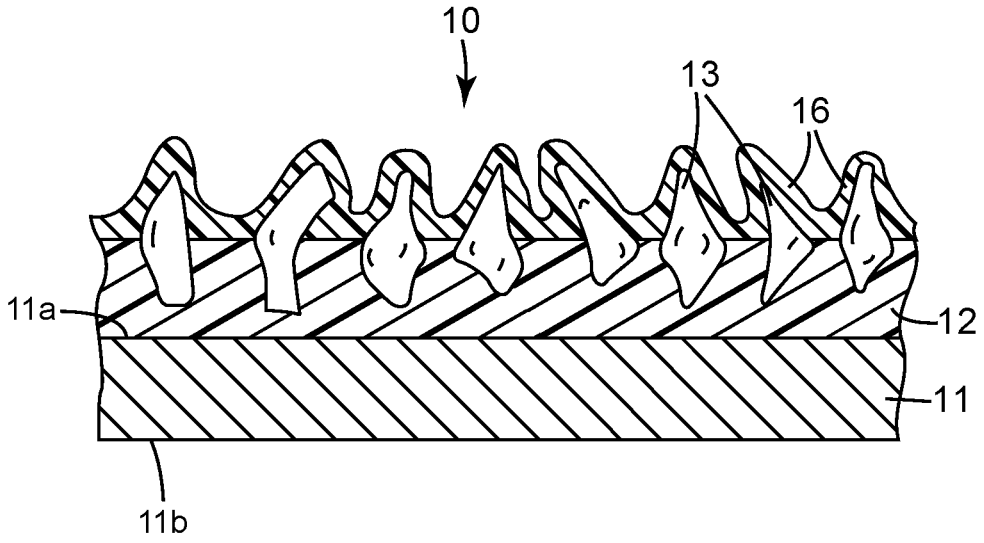
10
13
16
11a
12
11
11b

ABRASIVE ARTICLES INCLUDING A SATURANT AND AN ANTI-LOADING SIZE LAYER

CROSS REFERENCE TO RELATED APPLICATIONS

This application is a national stage filing under 35 U.S.C. 371 of PCT/CN2018/121974, filed Dec. 19, 2018, which claims priority to U.S. provisional application 62/698,729, filed Jul. 16, 2018, and also claims priority to U.S. provisional application 62/608,350, filed Dec. 20, 2017, the disclosure of which is incorporated by reference in its/their entirety herein.

BACKGROUND

There are numerous types of abrasive articles. For example, an abrasive article generally comprises abrasive particles bonded together as a bonded abrasive article, bonded to a backing as a coated abrasive article, or bonded into and/or onto a three-dimensional nonwoven substrate as a nonwoven abrasive article. Each type of abrasive article may also be provided in a variety of forms. For example, a coated abrasive article can comprise a first layer (also known as a make coat), a plurality of abrasive particles adhered thereto and therein, and a second layer (also known as a size coat). In some instances, a third layer (also known as a supersize coat) may be applied over the size coat. Alternatively, a coated abrasive article may be a lapping coated abrasive comprising an abrasive coating (which also can be referred to as an "abrasive layer") bonded to a backing where the abrasive coating comprises a plurality of abrasive particles dispersed in a binder. In addition, a coated abrasive article may be a structured abrasive comprising a plurality of precisely shaped abrasive composites bonded to a backing. In this instance, the abrasive composites comprise a plurality of abrasive particles. Abrasives articles are used to abrade a wide variety of substrates or workpieces made from, for example, wood, plastic, fiberglass, or soft metal alloys, or having a layer of enamel or paint. Typically, there is some degree of space between these abrasive particles. During the abrading process, material abraded from the substrate or workpiece, also known as swarf, tends to fill the spaces between abrasive particles. The filling of spaces between abrasive particles with swarf and the subsequent build-up of swarf is known as loading. Loading presents a concern because the life of the abrasive article is reduced, and the cut rate of the abrasive article decreases (thus, more force may be required to abrade). In addition, loading is an exponential problem; once swarf begins to fill in the spaces between abrasive particles, the initial swarf acts as a "seed" or "nucleus" for additional loading.

The abrasive industry has sought loading-resistant or anti-loading materials to use in abrasive articles. Preferred materials have been zinc stearate and calcium stearate. One theory for the success of metal stearates as an anti-loading agent is that the metal stearate coating powders off the coated abrasive surface during the abrading process, which in turn causes the swarf to also powder off of the surface, thus reducing the amount of loading.

Stearate coatings for the prevention of loading have been utilized by the abrasives industry for several decades. It has been common to utilize a binder with the stearate to assist in applying and retaining the coating on the abrasive surface. Some improvements over the years have been made by utilizing stearates with higher melting points, for example, calcium or lithium stearate and by incorporating additives to enhance anti-loading performance, for example, fluorochemicals.

SUMMARY

Although there have been a number of improvements recently for backings, bond systems, and minerals of coated abrasives, comparable improvements in anti-loading components have not yet been achieved. While stearate based anti-loading solutions are initially viable, they tend to slough off during use and are costlier to manufacture in terms of both time and materials. That is, the industry is still seeking a component which is easy to apply, is relatively inexpensive, and can be utilized during abrading of a variety of workpieces including paint, wood, wood sealers, plastic, fiberglass, composite material, and automotive body fillers and putties.

In the present disclosure, an anti-loading composition for an abrasive article has been developed which meets the needs of the industry, i.e., the present disclosure relates to an abrasive article construction containing an anti-loading composition which significantly reduces loading, is coatable, is durable, and is relatively inexpensive to manufacture. In particular, the use of the anti-loading compositions of the present disclosure as a size coat at least reduces if not eliminates the need for a supersize coat, while offering comparable if not superior performance and durability.

The present disclosure also provides improved backings for use with at least one of a desirable urea make resin and the anti-loading size compositions. The backings may be primed or saturated with saturant compositions including a binder resin and a compatible latex. Typically, treatments of porous substrates such as nonwovens are called saturants, while treatments of film substrates are called primers. In some such implementations, the backing includes a spunbonded nonwoven web, and optionally a polyethylene terephthalate film. The combination of such backings can improve the adhesion of a urea make resins, allowing abrasive articles made according to the present disclosure to offer high cutting performance, improved durability at a reduced material cost, and desirable manufacturing flexibility.

In one aspect, the present disclosure provides an abrasive article including a backing with a first major surface and an opposing second major surface, an abrasive layer bonded to at least a portion of the first major surface, with the abrasive layer comprising abrasive particles retained in a make coat. The article further includes an anti-loading size layer at least partially disposed on the abrasive layer, wherein the anti-loading size layer comprises a size coat binder at a concentration of at least 20 percent by weight of the composition and wax at a concentration of no greater than about 20 percent by weight of the composition.

In another aspect, the present disclosure provides an abrasive article including a backing with a first major surface and an opposing second major surface, and an abrasive layer bonded to at least a portion of the first major surface, the abrasive layer comprising abrasive particles retained in a make coat. The article further includes an anti-loading size layer at least partially disposed on the abrasive layer, wherein the size layer comprises a size coat binder, wax, and a latex.

In another aspect, the present disclosure provides an abrasive article comprising a backing with a first major surface and an opposing second major surface and an abrasive layer bonded to at least a portion of the first major surface, the abrasive layer comprising abrasive particles retained in a make coat. The article further comprises a size layer at least partially disposed on the abrasive layer, wherein the size layer comprises a formaldehyde-containing resin, polyethylene wax, and a vinyl acetate emulsion.

In yet another aspect, the present disclosure provides a method of abrading a workpiece, the method including: frictionally contacting an abrasive article with a workpiece, wherein the abrasive article comprises: a backing comprising a first major surface and an opposing second major surface; an abrasive layer bonded to at least a portion of the first major surface, the abrasive layer comprising abrasive particles retained in a make coat; and an anti-loading size layer at least partially disposed on the abrasive layer, wherein the size layer comprises a size coat binder and no greater than about 20 percent by weight of wax; and moving the abrasive article relative to the workpiece thereby abrading the workpiece.

In yet another aspect, the present disclosure provides an abrasive article comprising: a nonwoven fiber web backing comprising a first major surface and an opposing second major surface; the web including a saturant including a binder resin and a latex; an abrasive layer bonded to at least a portion of the first major surface, the abrasive layer comprising abrasive particles retained in a make layer; and an anti-loading size layer at least partially disposed on the abrasive layer, wherein the size layer comprises a size coat binder, wax, and a latex.

In another aspect, the present disclosure provides an abrasive article comprising: a backing comprising a first major surface and an opposing second major surface; and the backing further comprising polyethylene terephalate (PET) and a primer applied to the PET, wherein the primer includes a urea resin and a compatible latex; an abrasive layer bonded to at least a portion of the first major surface, the abrasive layer comprising abrasive particles retained in a make layer; and an anti-loading size layer at least partially disposed on the abrasive layer, wherein the anti-loading size layer comprises a size binder and wax at a concentration of no greater than about 20 percent by weight of the composition.

In yet another aspect, the present disclosure provides an abrasive article including: a backing comprising a first major surface and an opposing second major surface; and the backing further comprising a nonwoven material and a saturant contained in the nonwoven material, wherein the saturant includes at least one of a phenolic resin, acrylic, urea resin, and a combination thereof; an abrasive layer bonded to at least a portion of the first major surface, the abrasive layer comprising abrasive particles retained in a make layer; and an anti-loading size layer at least partially disposed on the abrasive layer, wherein the anti-loading size layer comprises a size binder and wax.

As used herein, the term "m.p." refers to melting point or melting range as indicated.

As used herein, "porosity" means a measure of void spaces in a material. Size, frequency, number, and/or interconnectivity of pores and voids contribute the porosity of a material.

As used herein, "void volume" means a percentage or fractional value for the unfilled space within a porous or fibrous body, such as a web or filter, which may be calculated by measuring the weight and volume of a web or filter, then comparing the weight to the theoretical weight of a solid mass of the same constituent material of that same volume.

As used herein, "Solidity" describes a dimensionless fraction (usually reported in percent) that represents the proportion of the total volume of a nonwoven web that is occupied by the solid (e.g., polymeric filament) material. Loft is 100% minus Solidity and represents the proportion of the total volume of the web that is unoccupied by solid material.

As used herein, "layer" means a single stratum that may be continuous or discontinuous over a surface.

The words "preferred" and "preferably" refer to embodiments of the disclosure that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure.

As recited herein, all numbers should be considered modified by the term "about".

As used herein, "a", "an", "the", "at least one", and "one or more" are used interchangeably. Thus, for example, a core comprising "a" pattern of recesses can be interpreted as a core comprising "one or more" patterns.

As used herein as a modifier to a property or attribute, the term "generally", unless otherwise specifically defined, means that the property or attribute would be readily recognizable by a person of ordinary skill but without requiring absolute precision or a perfect match (e.g., within +/−20% for quantifiable properties). The term "substantially", unless otherwise specifically defined, means to a high degree of approximation (e.g., within +/−10% for quantifiable properties) but again without requiring absolute precision or a perfect match. Terms such as same, equal, uniform, constant, strictly, and the like, are understood to be within the usual tolerances or measuring error applicable to the particular circumstance rather than requiring absolute precision or a perfect match.

The above summary of the present disclosure is not intended to describe each disclosed embodiment or every implementation of the present invention. The description that follows more particularly exemplifies illustrative embodiments. In several places throughout the application, guidance is provided through lists of examples, which examples can be used in various combinations. In each instance, the recited list serves only as a representative group and should not be interpreted as an exhaustive list.

BRIEF DESCRIPTION OF DRAWING

The present disclosure will be further described with reference to the accompanying drawings, in which:

FIG. 1 is a cross sectional view of an abrasive article according to the disclosure.

Layers in certain depicted embodiments are for illustrative purposes only and are not intended to absolutely define the thickness, relative or otherwise, or the location of any component. While the above-identified figures set forth several embodiments of the disclosure, other embodiments are also contemplated, as noted in the discussion. In all cases, this disclosure presents the disclosure by way of representation and not limitation. It should be understood that numerous other modifications and embodiments can be devised by those skilled in the art, which fall within the scope and spirit of the principles of the invention.

DETAILED DESCRIPTION

An improved abrasive article can be evaluated based on certain performance properties. First, such an article typically a desirable balance between cut and finish—that is, an acceptable efficiency in removing material from the workpiece, along with an acceptable smoothness of the finished surface. Second, an abrasive article would typically avoid excessive "loading", or clogging, which occurs when debris or swarf become trapped between the abrasive particles and hinder the cutting ability of the coated abrasive. Third, the abrasive article would desirably be both flexible and durable to provide for longevity in use. Fourth, the abrasive article would be relatively simple and cost-effective to manufacture.

The inventors of the present disclosure discovered an anti-loading composition that can advantageously balance among or improve performance in each of the above properties. The present inventors discovered that by modifying a size coat precursor with at least wax, the resulting abrasive article does not require a supersize coat to exhibit superior anti-loading properties and maintain cut durability. Moreover, by incorporating the anti-loading materials into the size resin itself, the present inventors are able to provide abrasive articles that avoid the gradual loss of anti-loading protection and durability endemic to peripheral coatings (e.g., stearate-based supersize coats). The improvements offered by the composition become especially prominent when finer abrasive particles (e.g., above 200 grit) are used in an abrasive article.

Referring now to the drawings, FIG. 1 shows a cross-section of an abrasive article 10, such as a sheet of sandpaper, comprising a backing 11 having opposed first 11*a* and second 11*b* major surfaces, at least one adhesive make layer 12 on the backing second major surface 11*b*, a plurality of abrasive particles 13 at least partially embedded in the make layer 12, and an anti-loading size layer (i.e., size coat) 14 extending over at least portions of the abrasive particles and make layer. The make layer(s) and abrasive particles cooperate to define an abrasive layer. The abrasive article 10 may be provided in, for example, a stack of individual sheets, or in roll form, wherein the abrasive article 10 may have an indefinite length.

As used herein, the expression "coating" refers generally to at least a single layer of generally flowable material, such as a liquid or a solid powder that can be applied directly to a surface. A coating, therefore, does not include a separate sheet of material laminated to a surface. As used herein, the expression "layer" refers generally to a material forming a discrete stratum, which may be continuous or discontinuous relative to a surface.

In one end use application of the disclosure, the abrasive article 10 may be used for hand sanding a work surface, such as a wooden surface or work piece. That is, the abrasive article 10 may be used to remove material from a surface by contacting the abrasive article 10 directly with one's hand (i.e., without the aid of a tool, such as a sanding block) and subsequently moving the abrasive article 10 against the work surface. It will be recognized that the present disclosure may also be used with manually-operated sanding tools and sanding blocks, or with power tools.

The backing layer 11, the make layer 12, and the abrasive particles 13, and the anti-loading size layer 16 are each described in detail below.

Backing

The backing 11 may be constructed from various materials known in the art for making abrasive articles, including coated abrasive backings and porous backings (e.g., nonwovens). Suitable materials for the backing 11 also include any of the materials commonly used to make sandpaper including, for example, paper, cloths (cotton, polyester, rayon) polymeric films such as thermoplastic films, foams, and laminates thereof. The backing 11 will typically have sufficient strength for handling during processing, sufficient strength to be used for the intended end use application. The thickness of the backing generally ranges from about 0.02 to about 5 millimeters, more preferably from about 0.05 to about 2.5 millimeters, and most preferably from about 0.1 to about 0.4 millimeters, although thicknesses outside of these ranges may also be useful.

The backing 11 may be made of any number of various materials including those conventionally used as backings in the manufacture of abrasive articles. Exemplary backings include polymeric film (including primed films) such as polyolefin film (e.g., polypropylene including biaxially oriented polypropylene, polyester film, polyamide film, cellulose ester film), metal foil, mesh, foam (e.g., natural sponge material or polyurethane foam (see U.S. Pat. No. 6,406,504 to Lise et al.)), cloth (e.g., cloth made from fibers or yarns comprising polyester, nylon, silk, cotton, and/or rayon), scrim, paper, coated paper, vulcanized paper, vulcanized fiber, nonwoven materials, combinations thereof, and treated versions thereof. The backing may also be a laminate of two materials (e.g., paper/film, cloth/paper, film/cloth). Cloth backings may be woven or nonwoven. In some embodiments, the backing is a thin and conformable polymeric film capable of expanding and contracting in transverse (i.e., in-plane) directions during use. The stretching of the backing material can be elastic (with complete spring back), inelastic (with zero spring back), or some mixture of both. This property can help promote contact between the abrasive particles 14 and the underlying substrate, and can be useful when the substrate includes raised and/or recessed areas. Numerous suitable backing materials for abrasive articles of the present disclosure are detailed and exemplified in U.S. Pat. No. 5,954,844 (Law et al.).

Highly conformable polymers that may be used in the backing 11 include certain polyolefin copolymers, polyurethanes, and polyvinyl chloride. One particularly preferred polyolefin copolymer is an ethylene-acrylic acid resin (available under the trade designation "PRIMACOR 3440" from Dow Chemical Company, Midland, Mich.). Optionally, ethylene-acrylic acid resin is one layer of a bilayer film in which the other layer is a polyethylene terephthalate (PET) carrier film. In this embodiment, the PET film is not part of the backing 11 itself and is stripped off prior to using the abrasive article 10.

In some implementations of the present disclosure, the article includes a PET film that defines at least one surface of the backing. For instance, the backing may include a PET film secured to a woven or nonwoven web (as further described below). In other instances, the backing consists essentially of a PET film, notwithstanding any primers or other additive layers.

The choice of backing material may depend on the intended application of the abrasive article. The thickness and smoothness of the backing is typically chosen to be suitable to provide the desired thickness and smoothness of the coated abrasive article, wherein such characteristics of the coated abrasive article may vary depending, for example, on the intended application or use of a coated abrasive article. The backing 11 may be flexible, such as described in US Publication No. 2017/0043450 (Graham et al.) or resilient, such as described in U.S. Pat. No. 6,406,504.

The backing 11 may be cast (e.g., from solvent or water) or extruded. It may contain one or more additives such as fillers, melt processing aids, antioxidants, flame retardants, colorants, or ultraviolet light stabilizers.

The backing 11 may, optionally, have at least one of a presize layer and/or a backsize layer. The purpose of these materials is typically to seal the backing and/or to protect yarn or fibers in the backing. The addition of the presize layer or backsize layer may additionally result in a 'smoother' surface on either the front and/or the back side of the backing.

In the illustrated embodiment, the backing layer 11 is continuous. That is, the backing layer 11 does not contain holes, openings, slits, voids, or channels extending there through in the Z-direction (i.e., the thickness or height dimension) that are larger than the randomly formed spaces between the material itself when it is made. The backing may also contain openings (i.e., be perforated), or contain slits. In some embodiments, the backing layer 11 is generally non-extensible. As used herein, the term "non-extensible" refers to a material having an elongation at break of no greater than about 25%. In some embodiments, the material has an elongation at break of no greater than about 10%. In some embodiments, the material has an elongation at break of no greater than about 5%.

In certain embodiments, the backing 11 may be relatively thin, and typically has a thickness of no greater than about 1.5 mm, no greater than about 1 mm, or no greater than about 0.75 mm. In such embodiments, the backing 11 is generally not resilient. The backing 11 may also be porous or non-porous. In another embodiment, such as when the backing 11 is a foam material, the backing 11 may be somewhat thicker. For example, in embodiments having a foam backing, the backing may have a thickness of at least about 2 mm, at least about 5 mm, or at least about 10 mm.

Suitable film materials for the backing 11 include polymeric films, including primed films, such as polyolefin film (e.g., polypropylene including biaxially oriented polypropylene, polyester film, polyamide film, cellulose ester film) and thermoplastic polyurethane film.

The backing 11 may also include a nonwoven fiber web, such that abrasive article 10 is a nonwoven abrasive article. Nonwoven fiber webs suitable for use in the aforementioned abrasive articles are well known in the abrasives art. The fibers may comprise continuous fiber, staple fiber, or a combination thereof. For example, the fiber web may comprise staple fibers having a length of at least about 20 millimeters (mm), at least about 30 mm, or at least about 40 mm, and less than about 110 mm, less than about 85 mm, or less than about 65 mm, although shorter and longer fibers (e.g., continuous filaments) may also be useful. The fibers may have a fineness or linear density of at least about 1.7 decitex (dtex, i.e., grams/10000 meters), at least about 6 dtex, or at least about 17 dtex, and less than about 560 dtex, less than about 280 dtex, or less than about 120 dtex, although fibers having lesser and/or greater linear densities may also be useful. Mixtures of fibers with differing linear densities may be useful, for example, to provide an abrasive article that upon use will result in a specifically preferred surface finish.

The fiber web may be made, for example, by conventional air laid, carded, stitch bonded, spun bonded, spun-laced, wet laid, and/or melt blown procedures. In particular embodiments, the backing comprises multiple layers of nonwoven materials with, for example, at least one layer of a melt-blown nonwoven and at least one layer of a spunbonded nonwoven, or any other suitable combination of nonwoven materials. For example, the core may be a spunbond-meltbond-spunbond, spunbond-spunbond, or spunbond-spunbond-spunbond multilayer material. Or, the backing may be a composite web comprising a nonwoven layer and a film layer.

"Meltblowing", as used herein, means a method for forming a nonwoven fibrous web by extruding a molten fiber-forming material through a plurality of orifices in a die to form fibers while contacting the fibers with air or other attenuating fluid to attenuate the fibers into fibers, and thereafter collecting the attenuated fibers. An exemplary meltblowing process is taught in, for example, U.S. Pat. No. 6,607,624 (Berrigan et al.). "Meltblown fibers" means fibers prepared by a meltblowing or meltblown process. "Spun-bonding" and "spun bond process" mean a method for forming a nonwoven fibrous web by extruding molten fiber-forming material as continuous or semi-continuous fibers from a plurality of fine capillaries of a spinneret, and thereafter collecting the attenuated fibers. An exemplary spun-bonding process is disclosed in, for example, U.S. Pat. No. 3,802,817 to Matsuki et al. "Spun bond fibers" and "spun-bonded fibers" mean fibers made using spun-bonding or a spun bond process. Such fibers are generally continuous fibers and are entangled or point bonded sufficiently to form a cohesive nonwoven fibrous web such that it is usually not possible to remove one complete spun bond fiber from a mass of such fibers. The fibers may also have shapes such as those described, for example, in U.S. Pat. No. 5,277,976 to Hogle et al, which describes fibers with unconventional shapes. "Carding" and "carding process" mean a method of forming a nonwoven fibrous web webs by processing staple fibers through a combing or carding unit, which separates or breaks apart and aligns the staple fibers in the machine direction to form a generally machine direction oriented fibrous nonwoven web. Exemplary carding processes and carding machines are taught in, for example, U.S. Pat. No. 5,114,787 to Chaplin et al. and U.S. Pat. No. 5,643,397. "Bonded carded web" refers to nonwoven fibrous web formed by a carding process wherein at least a portion of the fibers are bonded together by methods that include for example, thermal point bonding, autogenous bonding, hot air bonding, ultrasonic bonding, needle punching, calendering, application of a spray adhesive, and the like. Further details regarding the production and characteristics of nonwoven webs and laminates including nonwoven webs may be found, for example, in U.S. Pat. No. 9,469,091 (Henke et al.), which is incorporated by reference in its entirety herein. "Air-laying" refers to a process in which bundles of small fibers having typical lengths ranging from about 3 to about 52 millimeters (mm) are separated and entrained in an air supply and then deposited onto a forming screen, usually with the assistance of a vacuum supply. The randomly oriented fibers may then be bonded to one another using, for example, thermal point bonding, autogenous bonding, hot air bonding, needle punching, calendering, a spray adhesive, and the like. An exemplary air-laying process is taught in, for example, U.S. Pat. No. 4,640,810 to Laursen et al. Air laid fiber webs may be prepared using equipment such as, for example, that available under the trade designation RANDO WEBBER from Rando Machine Company of Macedon, N.Y. "Wet-laying" refers to a is a process in which bundles of small fibers having typical lengths ranging from about 3 to about 52 millimeters (mm) are separated and entrained in a liquid supply and then deposited onto a forming screen, usually with the assistance of a vacuum supply. Water is typically the preferred liquid. The randomly deposited fibers may by further entangled (e.g., hydro-entangled), or may be bonded to one another using, for example, thermal point bonding, autogeneous bonding, hot air bonding, ultrasonic bonding, needle punching, calendering, application of a spray adhesive, and the like. An exemplary wet-laying and bonding process is taught in, for example, U.S. Pat. No. 5,167,765 to Nielsen et al. Exemplary bonding processes are also disclosed in, for example, U.S. Pat. No. 9,139,940 to Berrigan et al.

The fiber web is typically reinforced, for example, using a prebond resin (e.g., a phenolic, urethane, or acrylic resin), by including core-sheath melty fibers, and/or by mechanical entanglement (e.g., hydroentanglement, or needletacking) using methods well-known in the art. The fiber web may optionally incorporate or be secured to a scrim and/or backing (e.g., using glue or a hot-melt adhesive or by needletacking), if desired, for additional reinforcement. The scrim, which is typically a woven or nonwoven reinforcement made from fibers, is included to provide strength to the nonwoven article. Suitable scrim materials include, but are not limited to, nylon, polyester, fiberglass, polyethylene, polypropylene, and the like. The average thickness of the scrim can vary. The layer of the scrim may optionally be bonded to the nonwoven substrate. A variety of adhesive materials can be used to bond the scrim to the substrate. Alternatively, the scrim may be heat-bonded to the nonwoven.

Useful nonwoven webs may have any suitable EFD, basis weight or thickness that is desired for a particular abrasive application. "Effective Fiber Diameter" or "EFD" is the apparent diameter of the fibers in a fiber web based on an air permeation test in which air at 1 atmosphere and room temperature is passed through a web sample at a specified thickness and face velocity (typically 5.3 cm/sec), and the corresponding pressure drop is measured. Based on the measured pressure drop, the Effective Fiber Diameter is calculated as set forth in Davies, C. N., The Separation of Airborne Dust and Particulates, Institution of Mechanical Engineers, London Proceedings, IB (1952). The fibers of the nonwoven web typically have an effective fiber diameter of from at least 0.1, 1, 2, or even 4 micrometers and at most 125, 75, 50, 35, 25, 20, 15, 10, 8, or even 6 micrometers. Spunbond nonwoven webs typically have an EFD of no greater than 35, while air-laid nonwovens may have a larger EFD on the order of 100 microns. The nonwoven backing preferably has a basis weight in the range of at least 5, 10, 20, or even 50 g/m$^2$; and at most 800, 600, 400, 200, or even 100 g/m$^2$. Basis weight is calculated from the weight of a 10 cm×10 cm sample. The minimum tensile strength of the nonwoven web is typically about 4.0 Newtons in the machine direction.

Nonwoven fiber webs are typically selected to be suitably compatible with adhering binders and abrasive particles while also being processable in combination with other components of the article, and typically can withstand processing conditions (e.g., temperatures) such as those employed during application and curing of the curable composition. Any of the non-woven webs may be made from a single type of fiber or two or more fibers that differ in type, shape, and/or thickness; the single fiber type or at least one of the multiple fiber types may each be a multicomponent fiber as described above. The fibers may be chosen to affect properties of the abrasive article such as, for example, flexibility, elasticity, durability or longevity, abrasiveness, and finishing properties. Examples of fibers that may be suitable include natural fibers, synthetic fibers, and mixtures of natural and/or synthetic fibers. Examples of synthetic fibers include those made from polyester (e.g., PET, nylon (e.g., hexamethylene adipamide, or polycaprolactam), polypropylene, acrylonitrile (i.e., acrylic), rayon, cellulose acetate, polyvinylidene chloride-vinyl chloride copolymers, and vinyl chloride-acrylonitrile copolymers. Examples of suitable natural fibers include cotton, wool, jute, and hemp. The fiber may be of virgin material or of recycled or waste material, for example, reclaimed from garment cuttings, carpet manufacturing, fiber manufacturing, or textile processing. The fiber may be homogenous or a composite such as a bicomponent fiber (e.g., a co-spun sheath-core fiber). The fibers may be tensilized and crimped. Combinations of fibers may also be used.

Under presently preferred conditions, the nonwoven backing includes PET fibers. In other embodiments, the nonwoven backing consists essentially of PET fibers. In more particular embodiments, the nonwoven backing includes at least one of spunbond PET fibers and airlaid PET fibers. The use of spunbond or airlaid PET can provide improved durability, tear resistance, conformability to the surfaces being abraded, manufacturing flexibility, and potentially reduced manufacturing costs, as well as improved compatibility with certain saturant compositions (as described below). Either PET backing may also be combined with a unitary or multilayer PET film.

Prior to coating with a curable composition (e.g., make layer 12 and/or saturant), the nonwoven fiber web typically has a weight per unit area (i.e., basis weight) of at least about 100 grams per square meter (gsm), at least about 200 gsm, or at least about 300 gsm; and/or less than about 500 gsm, less than about 450 gsm, or less than about 400 gsm, as measured prior to any coating (e.g., with the curable composition or optional pre-bond resin), although greater and lesser basis weights may also be used. In addition, prior to impregnation with the curable composition, the fiber web typically has a thickness of at least about 1 millimeters (mm), at least about 2 mm, or at least about 3 mm; and/or less than about 100 mm, less than about 50 mm, or less than about 25 mm, although greater and lesser thicknesses may also be useful.

Frequently, as known in the abrasive art, it is useful to apply a pre-bond resin to the nonwoven fiber web prior to coating with the make coat. The pre-bond resin serves, for example, to help maintain the nonwoven fiber web integrity during handling, and may also facilitate bonding of the make resin to the nonwoven fiber web. Examples of prebond resins include phenolic resins, urethane resins, hide glue, acrylic resins, urea-formaldehyde resins, melamine-formaldehyde resins, epoxy resins, and combinations thereof. The amount of pre-bond resin used in this manner is typically adjusted toward the minimum amount consistent with bonding the fibers together at their points of crossing contact. In those cases, wherein the nonwoven fiber web includes thermally bondable fibers, thermal bonding of the nonwoven fiber web may also be helpful to maintain web integrity during processing. Various other optional conventional treatments and additives may be used in conjunction with the nonwoven fiber web such as, for example, application of antistatic agents, lubricants, or corona treatment. Further details regarding nonwoven abrasive articles and methods for their manufacture can be found, for example, in U.S. Pat. No. 2,958,593 (Hoover et al.); U.S. Pat. No. 4,227,350 (Fitzer); U.S. Pat. No. 4,991,362 (Heyer et al.); U.S. Pat. No. 5,712,210 (Windisch et al.); U.S. Pat. No. 5,591,239 (Edblom et al.); U.S. Pat. No. 5,681,361 (Sanders); U.S. Pat. No. 5,858,140 (Berger et al.); U.S. Pat. No. 5,928,070 (Lux); U.S. Pat. No. 6,017,831 (Beardsley et al.); and U.S. Pat. No. 6,207,246 (Moren et al.).

Saturant/Primer

In embodiments of abrasive articles including nonwoven fiber webs backing materials, the backing includes a saturant. According to a particular aspect, the saturant can be contained within the porosity of the non-woven material. Generally, the saturating composition includes at least one of a polymeric binder resin, a latex, optional additional components. In particular instances, the saturant may include a binder resin selected from the group comprising of the phenolic resin, acrylic, urea resin, and a combination thereof. According to one presently preferred embodiment, the binder comprises urea-formaldehyde resin.

The saturant may extend substantially uniformly throughout an entire volume of the non-woven material (e.g., the spunlace polyester-based material or spunbond PET) of the backing. For example, the saturant may extend substantially uniformly throughout an entire thickness of the non-woven material (e.g., the spunlace polyester-based material) of the backing. Moreover, in certain instances, the saturant may be substantially disposed within the pores of the non-woven material (e.g., PET material) In other structures according to embodiments herein, the saturant can be substantially uniformly distributed throughout the entire volume of the non-woven material, such that the content of the saturant may be substantially uniform at the major surface, the lower major surface, and any region in between within the interior volume of the backing.

The saturant may further include a compatible latex. By compatible latex, it is meant that the presence of the latex will not cause the formulation to become too thick to effectively coat or to segregate into different layers. Compatible latexes can be crosslinkable or crosslinked. Compatible latexes include latexes such as cellulose, natural rubber, butadiene rubber, styrene-butadiene rubber, styrene-butadiene-acrylonitrile rubber, chloroprene rubber and methylbutadiene rubber, and acrylic, vinyl acetate and ethylene vinyl acetate emulsions. These latexes are commercially available from a variety of different sources and include those available under the trade designations RHOPLEX (e.g., RHOPLEX TR407 & RHOPLEX HA16) and ACRYLSOL commercially available from Rohm and Haas Company, FLEXCRYL and VALTAC commercially available from Air Products & Chemicals Inc., SYNTHEMUL, TYCRYL, and TYLAC commercially available from Reichold Chemical Co., HYCAR (e.g., HYCAR 2679) and GOODRITE commercially available from B. F. Goodrich, CHEMIGUM commercially available from Goodyear Tire and Rubber Co., NEOCRYL commercially available from ICI, BUTOFAN commercially available from BASF, RES commercially available from Union Carbide, DUR-O-SET, X-LINK (e.g., X-2712) and TUFCOR (e.g., TUFCOR 1214, TUFCOR 1063, and TUFCOR 5750), each commercially available from Celanese, Florence Ky. In presently preferred implementations, the latex is an acrylic, a cellulose, a vinyl acetate emulsion, an ethylene vinyl acetate emulsion, or combinations thereof. In particularly preferred implementations, the latex is a crosslinkable acrylic resin.

A particularly suitable saturant composition includes a urea formaldehyde resin and an acrylic latex. The inventors of the present disclosure discovered that the combination of UF resin and acrylic latex can provide adequate adhesion to fiber backing, flexibility, high strength and compatibility with UF make coats.

The saturant composition can comprise from about 90 to 10 parts of the binder resin and, correspondingly, from about 10 to 90 parts of the latex, as well as any additives as described below. More particularly, the saturant precursor can comprise 75 to 10 parts of the binder resin and, correspondingly, from about 25 to 90 parts of the latex. Even more particularly, the 75 to 25 parts of the binder resin and, correspondingly, from about 25 to 75 parts of the latex, as well as any additives a described below. Where the nonwoven backing includes spunbond PET fibers, it may be advantageous under certain circumstances to use equal parts binder resin and latex.

The amount of binder resin in comparison to latex in the saturant precursor can define a saturant ratio. The saturant ratio is typically no greater than 5:1. In some embodiments the saturant ratio is no greater than 4:1, no greater than 3:1, no greater than 2:1, and no greater than 1.5:1.

The saturating composition can be applied to the backing according to any method, including before, after, or during the nonwoven web creation process. Preferably, the saturating composition is saturated into the fibrous web after it is formed. Any known saturation technique may be employed, such as brushing, flooded nip saturation, doctor blading, spraying, and direct and offset gravure coating. Other suitable techniques for impregnating a web with a saturating composition are described in U.S. Pat. No. 5,595,828 to Weber and U.S. Patent Application Publication No. 2002/0168508 to Reed, et al.

The amount of the saturating composition applied may vary depending on the desired properties of the backing, such as the desired permeability. Typically, the saturating composition is present at an add-on level of about 10% to about 100%, and in some embodiments, from about 40% to about 80%. The add-on level can be calculated by dividing the dry weight of the saturating composition applied by the dry weight of the web before treatment and multiplying the result by 100.

The saturant compositions described above are also suitable as primers for polymeric film backings. The proposition holds for circumstances where the film is the primary backing or where it is used in combination with other materials. In certain presently preferred embodiments of the present disclosure, the saturant/primer is applied to a PET film.

Make Layer

In general, any adhesive make coat 12 may be used to adhere the abrasive particles 13 to the backing 11. "Make coat" and "make layer" are used interchangeably, and refer to the layer(s) of hardened (i.e., cured) resin over the backing 11 of the article 10. The make layer 12 can be prepared by curing a make precursor to adhere a plurality of abrasive particles to the backing. Suitable materials for the adhesive make layer 12 include, for example, phenolic resins (such as phenolic formaldehyde resins), aminoplast resins having pendant $\alpha,\beta$-unsaturated carbonyl groups, urethane resins, epoxy resins, ethylenically unsaturated resins, acrylated isocyanurate resins, vinyl acetate resins (e.g., polyvinyl acetate), melamine resins, urea-aldehyde resins, isocyanurate resins, acrylated urethane resins, acrylated epoxy resins, bismaleimide resins, fluorene-modified epoxy resins, and combinations thereof.

Organic binders suitable for a make and or size layer are formed from an organic binder precursor; it is, however, within the scope of the present disclosure to use a water-soluble binder precursor or water-dispersible binder precursor, such as hide glue.

Phenolic resins are commonly used as an abrasive article make coat precursor because of their thermal properties, availability, cost and ease of handling. Two common types of phenolic resins are resole and novolac. Resole phenolic resins have a molar ratio of formaldehyde to phenol, of greater than or equal to one to one, typically between 1.5:1.0 to 3.0:1 0 (slashed zero) Novolac resins have a molar ratio of formaldehyde to phenol, of less than one to one. The phenolic resin is preferably a resole phenolic resin, or at least a formaldehyde containing phenolic resin. Alkaline catalysts suitable for catalyzing the reaction between aldehyde and phenolic components of resole phenolic resins include sodium hydroxide, barium hydroxide, potassium hydroxide, calcium hydroxide, organic amines, and sodium carbonate, all as solutions of the catalyst dissolved in water.

Examples of commercially available phenolic resins include those known under the trade designations VARCUM and DUREZ from Occidental Chemical Corp., Tonawanda, N.Y.; AEROFENE and AEROTAP from Ashland Chemical Company, Columbus, Ohio; RESINOX from Monsanto, St. Louis, Mo.; and BAKELITE from Union Carbide, Danbury, Conn.

Resole phenolic resins are typically coated as a solution with water and/or organic solvent (e.g., alcohol). Typically, the solution includes about 70 percent to about 85 percent solids by weight, although other concentrations may be used. If the solids content is very low, then more energy is required to remove the water and/or solvent. If the solids content is very high, then the viscosity of the resulting phenolic resin is too high which typically leads to processing problems.

It is also within the scope of the present disclosure to modify the physical properties of a phenolic resin. For example, a plasticizer, latex resin, or reactive diluent may be added to a phenolic resin to modify flexibility and/or hardness of the cured phenolic binder.

A commonly preferred aminoplast resin is one having at least one pendant α,β-unsaturated carbonyl groups per molecule, which can be prepared according to the disclosure of U.S. Pat. No. 4,903,440 (Larson et al.) which is incorporated herein by reference.

Aminoplast resins have at least one pendant α,β-unsaturated carbonyl group per molecule or oligomer. These unsaturated carbonyl groups can be acrylate, methacrylate or acrylamide type groups. Examples of such materials include N-hydroxymethyl-acrylamide, N,N'-oxydimethylenebisacrylamide, ortho and para acrylamidomethylated phenol, acrylamidomethylated phenolic novolac and combinations thereof. These materials are further described in U.S. Pat. Nos. 4,903,440; 5,055,113; and 5,236,472 all incorporated herein by reference.

Polyurethanes may be prepared by reacting near stoichiometric amounts of polyisocyanates with polyfunctional polyols. The more common types of polyisocyanates are toluene diisocyanate (TDI) and 4,4'-diisocyanatodiphenylmethane (MDI) which are available under the trade designations "Isonate" from Upjohn Polymer Chemicals, Kalamazoo, Mich. and "Mondur" from Miles, Inc., Pittsburgh, Pa. Common polyols for flexible polyurethanes are polyethers such as polyethylene glycols, which are available under the trade designations CARBOWAX from Union Carbide, Danbury, Conn.; VORANOL from Dow Chemical Co., Midland, Mich.; and PLURACOL E from BASF Corp., Mount Olive, N.J.; polypropylene glycols, which are available under the trade designations PLURACOL P from BASF Corp. and VORANOL from Dow Chemical Co., Midland, Mich.; and polytetramethylene oxides, which are available under the trade designations POLYMEG from QO Chemical Inc., Lafayetts, Ind.; POLY THF from BASF Corp., Mount Olive, N.J.; and TETRATHANE from DuPont, Wilmington, Del. Hydroxyl functional polyesters are available under the trade designations MULTRANOL and DESMOPHENE from Miles, Inc., Pittsburgh, Pa. Virtually all polyurethane formulations incorporate one or more catalysts. Tertiary amines and certain organometallic compounds, especially those based on tin, are most common. Combinations of catalysts may be used to balance the polymer-formation rate.

Epoxy resins have an oxirane ring and are polymerized by the ring opening. Such epoxide resins include monomeric epoxy resins and polymeric epoxy resins. These resins can vary greatly in the nature of their backbones and substituent groups. For example, the backbone may be of any type normally associated with epoxy resins and substituent groups thereon can be any group free of an active hydrogen atom that is reactive with an oxirane ring at room temperature. Representative examples of acceptable substituent groups include halogens, ester groups, ether groups, sulfonate groups, siloxane groups, nitro groups and phosphate groups. Examples of some preferred epoxy resins include 2,2-bis4-(2,3-epoxypropoxyphenol)propane (diglycidyl ether of bisphenol A) and commercially available materials under the trade designations, EPON 828", "EPON 1004, and EPON 1001F, available from Shell Chemical Co., Houston, Tex.; "DER-331", "DER-332", and "DER-334" available from Dow Chemical Co., Midland, Mich. Other suitable epoxy resins include glycidyl ethers of phenol formaldehyde novolac (e.g., "DEN-431" and "DEN-438" available from Dow Chemical Co., Midland, Mich.). Other epoxy resins include those described in U.S. Pat. No. 4,751,138 (Tumey et al.), incorporated herein by reference.

Urea-aldehyde resins employed in precursor compositions of the present disclosure may be comprised of a reaction product of urea or any urea derivative and any aldehyde which are capable of being rendered coatable, have the capability of curing together at an accelerated rate in the presence of a catalyst, preferably a cocatalyst, and which afford an abrasive article with abrading performance acceptable for the intended use. Urea-formaldehyde resins are generally preferred in the abrasive industry, as noted above, because of their availability, low cost, and ease of handling. Urea-aldehyde resins preferably are 30-95% solids, more preferably 60-80% solids, with a viscosity ranging from about 125 to about 1500 cps (Brookfield viscometer, number 3 spindle, 30 rpm 25 (degree) C.) before addition of water and catalyst and have molecular weight (number average) of at least about 200, preferably varying from about 200 to 700. Urea aldehyde resins useful for the present disclosure include those described in U.S. Pat. No. 5,486,219 (Ford et al.), incorporated herein by reference.

Urea resin binder precursor systems typically employ a cocatalyst system. The cocatalyst may consist essentially of a Lewis acid, preferably aluminum chloride (AlCl3), and an organic or inorganic salt. A Lewis acid catalyst is defined simply as a compound which accepts an electron pair, and preferably has an aqueous solubility at 15 (degree) C. of at least about 50 grams/cc.

Lewis acids (or compounds which behave as Lewis acids) which are preferred are aluminum chloride, iron (III) chloride, and copper (II) chloride. A Lewis acid which is particularly preferred is aluminum chloride in either its non-hydrated form (AlCl3) or hexahydrate from (AlCl3 6H2 O).

The Lewis acid is typically and preferably used in the binder precursor system at an amount ranging from about 0.1 to about 5.0 weight percent of the total weight of binder precursor, as a 20-30% solids aqueous solution. If aluminum chloride (AlCl3) is used, it has been found that 0.6 weight percent of a 28% solids aqueous solution of AlCl3 gives preferable results.

Acrylate resins include both monomeric and polymeric compounds that contain atoms of carbon, hydrogen and oxygen, and optionally, nitrogen and the halogens. Oxygen or nitrogen atoms or both are generally present in ether, ester, urethane, amide, and urea groups. Ethylenically unsaturated compounds preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of acrylate resins include methyl methacrylate, ethyl methacrylate, ethylene glycol diacrylate, ethylene glycol dimethacrylate, hexanediol diacrylate, triethylene glycol diacrylate, trimethylolpropane triacrylate, glycerol triacrylate, pentaerythritol triacrylate, pentaerythritol trimethacrylate, pentaerythritol tetraacrylate and pentaerythritol tetramethacrylate, as well as these unsaturated monomers, for example, styrene, divinylbenzene, vinyl toluene.

Acrylated isocyanurates are isocyanurate derivates having at least one pendant acrylate group, which are further described in U.S. Pat. No. 4,652,274 (Boettcher et al.), incorporated herein by reference. A preferred acrylated isocyanurate is the triacrylate of tris(hydroxyethyl) isocyanurate.

Acrylated urethanes are diacrylate esters of hydroxy terminated isocyanate extended polyesters or polyethers. Examples of commercially available acrylated urethanes include those available under the trade designations, UVITHANE 782, CMD 6600, CMD 8400, and CMD 8805, from Radcure Specialties, Inc., Atlanta, Ga.

Acrylated epoxies are monoacrylate and diacrylate esters of epoxy resins, such as the diacrylate esters of bisphenol A epoxy resin. Examples of commercially available acrylated epoxies include CMD 3500, CMD 3600, and CMD 3700, available from Radcure Specialties, Inc., Atlanta, Ga.

Bismaleimide resins are further described in the assignee's U.S. Pat. No. 5,314,513, which is incorporated herein by reference.

Catalysts and/or curing agents may be added to the make coat precursor to initiate and/or accelerate the polymerization process. The make coat precursor can include a radiation-cured resin. A radiation-curing resin is a resin that is at least partially hardened or is at least partially polymerizable by radiation energy. Depending on the resin material to be used, an energy source such as heat, infrared radiation, electron beam radiation, ultraviolet radiation, or a visible light radiation is suitable for initiating cure.

In addition to thermosetting resins, a hot melt resin may also be used. For example, a make coat precursor system may comprise a hot melt pressure sensitive adhesive which can be energy cured to provide a binder. In this instance, because the make precursor is a hot melt composition, it is particularly useful with porous cloth, textile or fabric backings. Since this make precursor does not penetrate the interstices of the porous backing, the natural flexibility and pliability of the backing is preserved. Exemplary hot melt resins are described in U.S. Pat. No. 5,436,063 (Follett et al.), incorporated herein by reference.

The hot melt binder precursor system may comprise an epoxy-containing material, a polyester component, and an effective amount of an initiator for energy curing the binder. More particularly, the binder precursor can comprise from about 2 to 95 parts of the epoxy-containing material and, correspondingly, from about 98 to 5 parts of the polyester component, as well as the initiator. An optional hydroxyl-containing material having a hydroxyl functionality greater than 1 may also be included.

The make coat 12 may be coated onto the backing 11 by any conventional technique, such as knife coating, spray coating, roll coating, rotogravure coating, curtain coating, and the like.

Abrasive Particles

In general, any abrasive particles 13 may be used in the abrasive articles of this disclosure. Suitable abrasive particles include, for example, fused aluminum oxide, heat treated aluminum oxide, alumina-based ceramics, silicon carbide, zirconia, alumina-zirconia, garnet, emery, diamond, ceria, cubic boron nitride, ground glass, quartz, titanium diboride, sol gel abrasives and combinations thereof. The abrasive particles 13 can be either shaped (e.g., rod, triangle, or pyramid) or unshaped (i.e., irregular). The term "abrasive particle" encompasses abrasive grains, agglomerates, or multi-grain abrasive granules. The abrasive particles 13 can be deposited onto the make coat 12 by any conventional technique such as electrostatic coating or drop coating.

Abrasive particles suitable for use in abrasive layers utilized in practice of the present disclosure include any abrasive particles known in the abrasive art. Exemplary useful abrasive particles include fused aluminum oxide based materials such as aluminum oxide, ceramic aluminum oxide (which may include one or more metal oxide modifiers and/or seeding or nucleating agents), and heat-treated aluminum oxide, silicon carbide, co-fused alumina-zirconia, diamond, ceria, titanium diboride, cubic boron nitride, boron carbide, garnet, flint, emery, sol-gel derived abrasive particles, and blends thereof. Desirably, the abrasive particles comprise fused aluminum oxide, heat-treated aluminum oxide, ceramic aluminum oxide, silicon carbide, alumina zirconia, garnet, diamond, cubic boron nitride, sol-gel derived abrasive particles, or mixtures thereof. Examples of sol-gel abrasive particles include those described U.S. Pat. No. 4,314,827 (Leitheiser et al.); U.S. Pat. No. 4,518,397 (Leitheiser et al.); U.S. Pat. No. 4,623,364 (Cottringer et al.); U.S. Pat. No. 4,744,802 (Schwabel); U.S. Pat. No. 4,770,671 (Monroe et al.); U.S. Pat. No. 4,881,951 (Wood et al.); U.S. Pat. No. 5,011,508 (Wald et al.); U.S. Pat. No. 5,090,968 (Pellow); U.S. Pat. No. 5,139,978 (Wood); U.S. Pat. No. 5,201,916 (Berg et al.); U.S. Pat. No. 5,227,104 (Bauer); U.S. Pat. No. 5,366,523 (Rowenhorst et al.); U.S. Pat. No. 5,429,647 (Laramie); U.S. Pat. No. 5,498,269 (Larmie); and U.S. Pat. No. 5,551,963 (Larmie).

The abrasive particles may be in the form of, for example, individual particles, agglomerates, abrasive composite particles, alpha alumina abrasive shards, and mixtures thereof. Exemplary agglomerates are described, for example, in U.S. Pat. No. 4,652,275 (Bloecher et al.) and U.S. Pat. No. 4,799,939 (Bloecher et al.). It is also within the scope of the present disclosure to use diluent erodible agglomerate grains as described, for example, in U.S. Pat. No. 5,078,753 (Broberg et al.). Abrasive composite particles comprise abrasive grains in a binder. Exemplary abrasive composite particles are described, for example, in U.S. Pat. No. 5,549,962 (Holmes et al.). Alpha alumina abrasive shards are described in U.S. Pat. No. 9,446,502 B2 (Erickson et al.).

The abrasive particles typically have an average diameter of from about 0.1 to about 2000 micrometers, more desirably from about 1 to about 1300 micrometers. Abrasive particles are generally graded to a given particle size distribution before use. Such distributions typically have a range of particle sizes, from coarse particles to fine particles. In the abrasive art, this range is sometimes referred to as a "coarse", "control", and "fine" fractions. The size of the abrasive particles used for a particular abrading application will be apparent to those skilled in the art.

Abrasive particles graded according to abrasive industry accepted grading standards specify the particle size distribution for each nominal grade within numerical limits. Such industry accepted grading standards (i.e., abrasive industry specified nominal grade) include those known as the American National Standards Institute, Inc. (ANSI) standards, Federation of European Producers of Abrasive Products (FEPA) standards, and Japanese Industrial Standard (JIS) standards.

ANSI grade designations (i.e., specified nominal grades) include: ANSI 4, ANSI 6, ANSI 8, ANSI 16, ANSI 24, ANSI 36, ANSI 40, ANSI 50, ANSI 60, ANSI 80, ANSI 100, ANSI 120, ANSI 150, ANSI 180, ANSI 220, ANSI 240, ANSI 280, ANSI 320, ANSI 360, ANSI 400, and ANSI 600. FEPA grade designations include P8, P12, P16, P24, P36, P40, P50, P60, P80, P100, P120, P150, P180, P220, P320, P400, P500, P600, P800, P1000, and P1200. JIS grade designations include JIS8, JIS12, JIS16, JIS24, JIS36, JIS46, JIS54, JIS60, JIS80, JIS100, JIS150, JIS180, JIS220, JIS240, JIS280, JIS320, JIS360, JIS400, JIS600, JIS800, JIS1000, JIS1500, JIS2500, JIS4000, JIS6000, JIS8000, and JIS10,000. For use in hand sanding applications such as wood trim and moldings (painted or unpainted) with shaped three-dimensional surfaces, the abrasive particles have a size distribution falling within the range of ANSI grades 100 to 320, inclusive.

Alternatively, the abrasive particles can be graded to a nominal screened grade using U.S.A. Standard Test Sieves conforming to ASTM E-11 "Standard Specification for Wire Cloth and Sieves for Testing Purposes". ASTM E-11 proscribes the requirements for the design and construction of testing sieves using a medium of woven wire cloth mounted in a frame for the classification of materials according to a designated particle size. A typical designation may be represented as −18+20 meaning that abrasive particles pass through a test sieve meeting ASTM E-11 specifications for the number 18 sieve and are retained on a test sieve meeting ASTM E-11 specifications for the number 20 sieve. In certain embodiments, the abrasive particles have a particle size such that most of the abrasive particle pass through an 18 mesh test sieve and can be retained on a 20, 25, 30, 35, 40, 45, or 50 mesh test sieve. In various embodiments of the present disclosure, the abrasive particles can have a nominal screened grade comprising: −18+20, −20+25, −25+30, −30+35, −35+40, −40+45, −45+50, −50+60, −60+70, −70+80, −80+100, −100+120, −120+140, −140+170, −170+200, −200+230, −230+270, −270+325, −325+400, −400+450, −450+500, or −500+635.

Coating weights for the abrasive particles may depend, for example, on the make coat precursor used, the process for applying the abrasive particles, and the size of the abrasive particles, but typically range from about 5 to about 250 grams per square meter (gsm), from 20 to 100 gsm, 30 to 80 gsm, and from 45 to 65 gsm; although other amounts may also be used.

Anti-Loading Size Layer

The anti-loading size layer 16 is disposed on the abrasive layer (i.e., make layer 12 and abrasive particles 13) and optionally backing 11. It may cover all, or more typically some, of either or both of the abrasive layer and the backing 11. The anti-loading size layer 16 can be prepared by curing an anti-loading composition, typically a size coat precursor. The anti-loading composition can be cured by radiation, catalyzed polymerization, or by exposure to ambient conditions (i.e., 20-25° C. and atmospheric pressure).

The anti-loading composition comprises a size binder resin (e.g., a cured and/or crosslinked size precursor). Suitable binders and precursors include those discussed hereinabove with regard to the make precursors and those commonly used in the art to prepare size precursors. The make and size precursors may have the same or different compositions, and may be applied at the same or different coat weights. In presently preferred implementations, the size binder resin is selected from the group consisting of phenolic formaldehyde resins, melamine formaldehyde resins, and urea formaldehyde resins. The amount of size binder is preferably at least 40 percent by weight (based on the total weight of the anti-loading composition), more preferably less than 50 percent by weight, more preferably at least than 60 percent by weight, more preferably at least 70 percent by weight of size binder. Accordingly, the anti-loading composition of the present disclosure forms a size layer once cured.

The anti-loading composition also includes at least 1 percent by weight (based on the total weight of the composition) of wax having a melting point onset (i.e., that temperature at which melting begins at one atmosphere of pressure (101 kPa)) in the range of from about 50° C. (122° F.) to about 143° C. (290° F.). As used throughout the specification and claims the term wax refers to all the combined total of waxes in the peripheral anti-loading composition. Individual wax components may melt outside the prescribed melting range as long as the total combination of all waxy components demonstrates the specified melting behavior.

Under presently preferred conditions and embodiments, the anti-loading composition comprises at least 1 percent by weight, at least 2 percent by weight, at least 5 percent by weight of wax, at least 10 percent by weight of wax, at least 15 percent by weight of wax, and up to 20 percent by weight of wax. As used herein, "wax" refers to hydrophobic materials having a solid state at room temperature (i.e., a melting point and a softening point above 30° C., preferably above 40° C., more preferably above 50° C. such as certain hydrocarbon materials having long chain aliphatic (fatty) oxygen-containing moieties, and, optionally, fatty ester, alcohol, acid, amide or amine, or alkyl acid phosphate groups. In presently preferred implementations, the anti-loading composition comprises no greater than 40 percent by weight, more preferably no greater than 25 percent by weight, more preferably no greater than 20 percent by weight of wax. A concentration of wax below this range may not deliver the desired anti-loading benefits, while a concentration above this range may result in excess lubricity and compromised cut durability in the anti-loading size layer.

In presently preferred implementations, the wax has a melting point onset in the range of from 60° C. to 150° C., more preferably 100° C. to 143° C., and more preferably from 110° C. to 135° C. For anti-loading compositions including a thermosetting size binder resin, it may be advantageous that the wax having a melting point onset above 100° C. (212° F.), so that wax does not melt as a result of typical abrasive manufacturing processes.

Suitable waxes for use in the anti-loading composition may include natural and synthetic waxes, both modified (e.g., oxidized) and un-modified. Suitable waxes include paraffin wax, polyethylene wax, carnuba wax, polypropylene wax, Ethylene bis stearamide (EBS) wax, and combinations thereof. The wax may be provided as an emulsion or dispersion (i.e., dispersed in water or other solvent) or micronized (i.e., powder form). Examples of suitable waxes include a synthetic hydrocarbon wax available as MP-22VF (m.p.=102-106° C.) from Micro Powders Inc., Tarrytown, N.Y.; a polyethylene wax for waterborne systems available as AQUAPOLY 215 (m.p.=105-111° C.) from Micro Powders Inc.; combinations of waxes such as, for example, a combination of polyethylene and carnauba wax available as MICROKLEAR 295 (m.p.=104-110° C.) from Micro Powders Inc.; a polyethylene wax for waterborne systems available as AQUAPOLY 250 (m.p.=117-123° C.) from Micro Powders Inc., Tarrytown, N.Y.; a high melting polyethylene wax (m.p.=(123-125° C.) available as MPP-635VF from Micro Powders Inc.; a modified polypropylene wax (m.p.=140-143° C.) available as MICROPRO 200 from Micro Powders Inc.; a modified polyethylene wax available as AQUACER 531, and other waterborne waxes AQUACER 494, and AQUACER 539, from BYK, Inc., and polyethylene wax GLIDD 6148 from Lanco and an EBS wax available as MICROMIDE 520 (m.p.=141-145° C.) from Micro Powders Inc. Particularly suitable waxes include polyethylene waxes (both modified and unmodified) and paraffin wax.

In presently preferred implementations, the wax is substantially compatible with the size binder resin. As used herein, as substantially compatible wax does not form precipitate when mixed or otherwise dispersed in the size resin. Without wishing to be bound by theory, the selection of compatible wax may hinge on the relative acidity of the size binder, such that waxes having a pH of at least 8 are particularly suitable for the formaldehyde-containing size resins presently preferred.

The anti-loading composition may further include a wax compatible latex. By wax compatible latex, it is meant that the presence of the latex will not cause the formulation to become too thick to effectively coat (for example, if an anti-loading composition includes 63% solids by weight, the viscosity should generally not exceed 1000 cps to be coatable), or to segregate into different layers. Wax compatible latexes can be crosslinkable or crosslinked. Wax compatible latexes include latexes such as cellulose, natural rubber, butadiene rubber, styrene-butadiene rubber, styrene-butadiene-acrylonitrile rubber, chloroprene rubber and methylbutadiene rubber, and acrylic, vinyl acetate and ethylene vinyl acetate emulsions. These latexes are commercially available from a variety of different sources and include those available under the trade designations RHOPLEX (e.g., RHOPLEX TR407 & RHOPLEX HA16) and ACRYLSOL commercially available from Rohm and Haas Company, FLEXCRYL and VALTAC commercially available from Air Products & Chemicals Inc., SYNTHEMUL, TYCRYL, and TYLAC commercially available from Reichold Chemical Co., HYCAR (e.g., HYCAR 2679) and GOODRITE commercially available from B. F. Goodrich, CHEMIGUM commercially available from Goodyear Tire and Rubber Co., NEOCRYL commercially available from ICI, BUTOFAN commercially available from BASF, RES commercially available from Union Carbide, DUR-O-SET, X-LINK (e.g., X-2712) and TUFCOR (e.g., TUFCOR 1214, TUFCOR 1063, and TUFCOR 5750), each commercially available from Celanese, Florence Ky. In presently preferred implementations, the latex is an acrylic, a cellulose, a vinyl acetate emulsion, an ethylene vinyl acetate emulsion, or combinations thereof. In particularly preferred implementations, the latex is a crosslinkable acrylic, cellulose, vinyl acetate, ethylene vinyl acetate, or combinations thereof.

Examples of suitable cellulose latexes include, but are not limited to, alkyl cellulose (e.g., methyl cellulose, ethyl cellulose, ethyl methyl cellulose), hydroxylalkyl cellulose (e.g., hydroxymethyl cellulose, hydroxyethyl cellulose, hydroxypropyl cellulose, hydroxypropyl methyl cellulose, hdyroxyethyl methyl cellulose, and hydroxyethyl ethyl cellulose), and carboxylalkyl cellulose (e.g., carboxymethyl cellulose). In present preferred implementations of the present disclosure, the cellulose is a hydoxylalkyl cellulose latex.

In some embodiments, suitable latexes for use with the anti-loading composition have a T(g) of between about −50° C. and about 115° C., and it yet other embodiments the latex has a T(g) of between about 5° C. and about 50° C.

If present, the wax compatible latex comprises at least 1 percent by weight, more preferably at least 2 percent by weight, more preferably at least 5 percent by weight of the total weight of the anti-loading composition.

In some embodiments, the latex is included in an amount from about 1% to about 15%, by weight of the anti-loading composition, such as from about 2% to about 12%, from about 3% to about 10%, from about 4% to about 8%, by weigh of the total anti-loading composition as formulated.

Additives

The make coat 16, the anti-loading layer 18, and/or the backing saturant may contain optional additives, such as fillers, fibers, lubricants, grinding aids, wetting agents, thickening agents, anti-loading agents, coupling agents, surfactants, pigments, dyes, coupling agents, photo-initiators, plasticizers, suspending agents, antistatic agents, and the like. Fillers are typically organic or inorganic particulates dispersed within the resin and may, for example, modify either the binder precursor or the properties of the cured layer, or both, and/or may simply, for example, be used to reduce cost. The fillers may be present, for example, to block pores and passages within the backing, to reduce its porosity and provide a surface to which the maker coat will bond effectively. The addition of a filler, at least up to a certain extent, typically increases the hardness and toughness of the cured binder. Moreover, the addition of certain fillers can also act as anti-loading materials. Inorganic particulate filler commonly has an average particle size ranging from about 0.5 micrometer to about 100 micrometers, more typically from about 1 to about 50 micrometers, and sometimes even from about 5 to about 30 micrometers. Though not wishing to be bound by theory, small particles of filler can combine with swarf from a sanded surface, such as a painted metal surface, to prevent sufficient agglomerating loading of swarf in a surface of the coated abrasive. That is, the filler particles are of such a size that, upon sanding a painted surface using the abrasive article to produce abraded swarf, particles of the anti-loading agent are released that combine with and inhibit the agglomeration of such swarf particles.

Examples of useful fillers include: metal carbonates such as calcium carbonate (in the form of chalk, calcite, marl, travertine, marble or limestone), calcium magnesium carbonate, sodium carbonate, and magnesium carbonate; silicas such as quartz, glass beads, glass bubbles and glass fibers; silicates such as talc, clays, feldspar, mica, calcium silicate (e.g., wollastonite), calcium metasilicate, sodium aluminosilicate, sodium-potassium alumina silicate, and sodium silicate; metal sulfates such as calcium sulfate, barium sulfate, sodium sulfate, aluminum sodium sulfate, and aluminum sulfate; gypsum; vermiculite; wood flour; alumina trihydrate; carbon black; metal oxides such as calcium oxide (lime), aluminum oxide, titanium dioxide, alumina hydrate, alumina monohydrate; and metal sulfites such as calcium sulfite. Fillers that can function as grinding aids include cryolite, potassium fluoroborate, feldspar, and sulfur. Cryolite may provide additional anti-loading benefits, as detailed in U.S. Pat. No. 6,451,076. The amounts of these materials are selected to provide the properties desired, as is known to those skilled in the art. If used, filler is typically present in the anti-loading composition at about 20 percent by weight of the total composition, though other concentrations may be appropriate based on the intended abrasive application.

The anti-loading composition can contain a coupling agent. Suitable examples of the coupling agent commonly used in the abrasive art include organic silane, zircoaluminate, and titanate. Suitable silane coupling agents include epoxy functional silanes, such as those described in International Publication No. WO2017062482 (Schillo-Armstrong et al.). The amount of the coupling agent is typically less than 5 wt %, preferably less than 1 wt %, of the anti-loading composition.

Any of the make and size precursors described above optionally include one or more curatives. Curatives include those that are photosensitive or thermally sensitive, and preferably comprise at least one free-radical polymerization initiator and at least one cationic polymerization catalyst, which may be the same or different.

Methods of Making

In one exemplary method of making the article 10, the make precursor is applied to the backing 11. Next, abrasive particles 13 are applied to the make precursor, and then make precursor can be optionally partially cured (e.g., to an a-stage or b-stage). The size precursor is then applied over the make layer precursor and abrasive particles and the make and size layer precursors sufficiently cured to form a useable abrasive article. Curing may be accomplished using thermal, atmospheric (e.g., drying), and/or photochemical methods.

In addition, it will be recognized that the backing 11 (with or without saturant/primer), make layer 12, and abrasive particles 13 may be provided in the form of a pre-formed (i.e., otherwise complete) abrasive sheet. That is, rather than providing a backing layer 11, which is then coated with make coat precursor and provided with abrasive particles 13 and at least partially cured to form an abrasive sheet, a pre-formed abrasive sheet including a backing, make coat and abrasive particles may be provided. The anti-loading size precursor can then be applied directly to the pre-formed abrasive sheet. If a pre-formed abrasive sheet is used, the size layer 16 may be applied using, for example, solvent coating, roll coating, hot melt coating, drop die, or powder coating techniques. For ease of manufacturing, it could be useful to provide the finished sandpaper in bulk form, and then coat the bulk sandpaper with the anti-loading size precursor prior to producing the individual sheets of sandpaper that are ultimately used by the end user. Advantageously, the elimination of a supersize coat serves to reduce the equipment necessary to create an abrasive article, leading to a meaningful reduction in manufacturing time.

A wide variety of commercially available conventional sandpaper constructions having a wide variety of backing materials (e.g., papers, films, cloths), weights (e.g., A, B, or C weight paper), and abrasive particles may be coated with an anti-loading composition according to the present disclosure.

Abrading may be carried out dry or wet. For wet abrading, the liquid may be introduced supplied in the form of a light mist to complete flood. Examples of commonly used liquids include: water, water-soluble oil, organic lubricant, and emulsions. The liquid may serve to reduce the heat associated with abrading and/or act as a lubricant. The liquid may contain minor amounts of additives such as bactericide, antifoaming agents, and the like.

Examples of workpieces include aluminum metal, carbon steels, mild steels (e.g., 1018 mild steel and 1045 mild steel), tool steels, stainless steel, hardened steel, titanium, glass, ceramics, wood, wood-like materials (e.g., plywood and particle board), paint, painted surfaces, and organic coated surfaces. The applied force during abrading typically ranges from about 1 to about 100 kilograms (kg), although other pressures can also be used.

In order that the disclosure described herein can be more fully understood, the following examples are set forth. It should be understood that these examples are for illustrative purposes only, and are not to be construed as limiting this disclosure in any manner.

EXAMPLES

| Materials | |
|---|---|
| ARCLIN 65-2024 | Urea-formaldehyde resin (65% solids in water), available from Arclin, Quebec, Canada |
| DURITE AL-3029c | Urea-formaldehyde resin (65% solids in water) available from Hexion Select, Bellevue, WA |
| PHENOLIC BB-077 | Resole phenol-formaldehyde resin (75 wt. % in water), a 1.5:1 to 2.1:1 (formaldehyde:phenol) condensate catalyzed by 1 to 5% metal hydroxide available from Arclin, Quebec, Canada |
| DUR-O-SET C-310 | Polyvinyl acetate emulsion (54% solids in water), Tg = 30°, available from Celanese, Irving, TX |
| TERGITOL 15-S-7 | Secondary alcohol ethoxylate nonionic surfactant, available from Dow Chemical Co., Midland, MI |
| ADVANTAGE AM1512A | Hydrocarbon oil-based foam control agent, available from Ashland Global Specialty Chemicals Inc., Covington, KY |
| ALUMINUM CHLORIDE | Aqueous solution of aluminum chloride, $AlCl_3 \bullet 6H_2O$ (28% solids), available from Sigma Aldrich, St. Louis, MO |
| AMMONIUM CHLORIDE | Aqueous solution of ammonium chloride $NH_4Cl$ (25% solids), available from Sigma Aldrich, St. Louis, MO |
| MINEX 10 | Functional filler produced from nepheline syenite, available from Unimin Corp., New Canaan, CT |
| HUBERCARB Q325 | Calcium Carbonate (CaC) filler product available from Huber Corp., Atlanta, GA |
| SUN GREEN CGD-9957 | Pigment product available from Heubac, Fairless Hills, PA |
| COATOSIL MP 200 | Epoxy functional silane oligomer, available from Momentive Performance Materials Inc., Waterford, NY |
| SILQUEST A-187 | Epoxy functional silanes product available from Momentive Corp., Waterford, NY |

-continued

| Materials | |
|---|---|
| AQUACER 531 | Polyethylene based wax emulsion (45% solids in water), 130° C. wax melting point, available from BYK Additives and Instruments, Germany |
| AQUACER 494 | Polyethylene based wax emulsion (55% solids in water), 65° C. wax melting point, available from BYK Additives and Instruments, Germany |
| LANCO GLIDD 6148 | Polyethylene based wax dispersion (53% solids in water), 105° C. wax melting point, available from Lubrizol Advanced Materials Inc., Brecksville, OH |
| AQUASLIP 671 | Polyethylene based wax emulsion (37% solids in water), 120-125° C. wax melting point, available from Lubrizol Advanced Materials Inc., Brecksville, OH |
| MP-28C | Spherical shaped, micronized synthetic wax, 104-110° C. melting point, available from Micro Powders Inc., Tarrytown, NY |
| TUFCOR 1214 | Vinyl acetate/ethylene copolymer (EVA) emulsion (55% solids in water), Tg = 11° C., available from Celanese Corp., Irving, TX |
| TUFCOR 5750 | Vinyl acetate homopolymer (PVA) emulsion (58% solids in water), Tg = 10° C., available from Celanese Corp., Irving, TX |
| TUFCOR 1063 | Vinyl acetate homopolymer (PVA) emulsion (58% solids in water), Tg = 20° C., available from Celanese Corp., Irving, TX |
| TUFCOR 3025 | Vinyl acetate homopolymer (PVA) emulsion (56% solids in water), Tg = 30° C., available from Celanese Corp., Irving, TX |
| HYCAR 2679 | Water based acrylic emulsion (49-50% solids), Tg = −3° C., available from Lubrizol Advanced Materials Inc., Brecksville, OH |
| ROVENE 5900 | SBR, Carboxylated styrene butadiene latex (50% solids) (available from Mallard Creek Polymers, Charlotte, NC) |
| RHOPLEX HA-12 | Water based acrylic emulsion (44.5-45.5% solids), Tg = 19° C., available from Dow Chemical Co., Midland, MI |
| RHOPLEX HA-16 | Water based acrylic emulsion (45.5% solids), Tg = 35° C., available from Dow Chemical Co., Midland, MI |
| ROVENE 4002 | Water based styrene-butadiene emulsion (49.5-51.5%solids), Tg = 4° C., available from Mallard Creek Polymers, Charlotte, NC |
| X-LINK 2712 | Vinyl acetate copolymer emulsion (44-46% solids in water), Tg = 30° C., available from Celanese Corp., Irving, TX |
| CELLOSIZE HEC | Hydroxyethyl Cellulose, (7.5%solids) Tg = 135° C., available from Dow Chemical Co., Midland, MI |
| ALBERDINGK U 9700 | Aliphatic polyurethane aqueous dispersion (34-36% solids), Konig Hardness = 30 secs, available from Alberdingk Boley Inc., Greensboro, NC |
| CALCIUM STEARATE | Aqueous solution of calcium stearate (40% solids), available from Devden Inc., Bromont, Quebec, Canada |
| PET SPUNBOND FIBER BACKING | Polyethylene terephthalate nonwoven web having a basis weight of 110 gsm, available from Shendong Taipeng Nonwovens, Shendong, China. |
| PET Staple Fiber | 15 denier recycled PET product available from Stein Fiber Ltd. 4 Computer Dr. West, Albany, NY |
| MELTY Staple Fiber | 15 denier Melty PET Fiber product from Huvis Ltd., Xian Xia Road, Shanghai, China |
| PET SCOTCH BRITE PAD | 75% 15 denier PET Staple Fiber and 25% 15 denier MELTY Staple Fiber nonwoven web, available from 3M Company, St. Paul, MN |
| PET Film | Unprimed 5 mil thick film available from 3M Company, St. Paul, MN |
| ABRASIVE MINERALS | Aluminum oxide available from Imerys Inc., Cockeysville, MD (80 grit, 120 grit, 150 grit) |

Abrasion Test

A 5 inch (12.7 cm) diameter abrasive disc to be tested was mounted on an electric rotary tool that was disposed over an X-Y table having a plastic panel measuring 15 inches×21 inches×0.375 inch (38.1 m×53.3 cm×0.95 cm) secured to the X-Y table. The tool was then set to traverse at a rate of 5.5 inches/second (14.0 cm/sec) in the X direction along the length of the panel, and traverse along the width of the panel at a rate of 3 inches/second (7.6 cm/sec). The rotary tool was then activated to rotate at 8000 rpm under no load. The abrasive article was then urged at an angle of 2.5 degrees against the panel at a load of 10 lbs (4.54 kg). The tool was then activated to move along the length and width of the board. The tool was then raised and returned to the starting point. Ten such grinding-and-return passes along the length of the panel were completed in each cycle for a total of 10 cycles. The mass of the panel was measured before and after each cycle to determine the total mass loss in grams after each cycle. A cumulative mass loss (total cut) was determined at the end of 10 cycles. The abrasive disc was weighed before and after the completion of the test (10 cycles) to determine the wear. The total cut and cut durability data for each Example provided in the Tables is an average of three samples that were tested. Cut durability was calculated: Cut Durability (%)=Final cut (Cycle 10)/Initial cut (Cycle 1)×100.

Anti-Loading Test

After abrasion testing the discs were visually examined and ranked from 1-5 to compare their anti-loading properties, where 1=very heavy loading; 2=heavy loading; 3=some loading; 4=little loading; 5=no or very little loading.

Cross Hatch Test for Films

The adhesion of the primer to the backing substrate were tested according to ASTM D3359-09, Part B, Standard Test Methods for Measuring Adhesion by Tape Test Put ratings hereThe cross-hatch test is used to test and quantify a coatings adhesion to a substrate. ASTM D3359.26972, Method B references this test. The first step is to lightly score the test surface with either a razor blade or other cutting six perpendicular lines with another six parallel cuts perpendicular to initial cuts. Cutting tools such as the Gardco Cross-cut tester from Paul N. Gardner Co, Pompano Beach, Fla. with 18546 circular cutting blade, 6 cutting edges/1 mm spacing can be used. This generates a grid with 25 squares 1 mm/1 mm. After the cross hatch pattern is made on the film, the surface is brushed off. A tape, such as 3M magic tape 810 (available from 3M Company, St. Paul, Minn.), is laminated to the cross-hatch area. The tape is removed quickly at a 180 degree peel angle. The adhesion is quantified by the number of squares that were removed. ASTM D3359 illustrates the rating scale. 5b classification means nothing was removed from the 25 squares. 4B, less than 5% of the area is removed, 3B (5-15% removed; 2B (15-35%) 1B (35-65%) 0B>65% area removed.

Shelling Test for Nonwoven Abrasives

A coated abrasive article (including an at least partially cured saturant, make, and size coats) is subjected to scratching with a fingernail. If the article in the tested area resists shelling of the abrasive and removal of any part of the coating, and the article provides good cut, the saturant is considered to be well adhered. The article is rated on a scale of 1-5 with 1 rated articles having the poorest adhesion, and 5 rated articles as being well adhered.

Preparation of Abrasive Discs—Anti-Loading (E1-E49)

Abrasive Particles:

Samples of coated abrasive backings were prepared using 80 or 220 grade abrasive particles, designated as P220 and P80 blends.

P220 is mineral blend of 85% by weight 220 grit size premium white, heat-treated aluminum oxide (available from Imerys Inc., Cockeysville, Md.) and 15% by weight ceramic aluminum oxide crushed abrasive particles (3M Ceramic Abrasive Grain 321 Grade 220), available from 3M Company, St. Paul, Minn.).

P80 is a mineral blend of 90% by weight 80 grit size premium white, heat-treated, aluminum oxide (available from Imerys Inc., Cockeysville, Md.) and 10% by weight 3M Precision Shaped Grain (PSG). The PSG shaped abrasive particles were prepared according to the disclosure of U.S. Pat. No. 8,142,531 (Adefris et al.). The PSG particles were in the general shape of equilateral triangles, with an average edge length of approximately 500 μm and a particles thickness of approximately 100 μm.

Make Coating 1:

The formulation of the make coating for Examples 1-74 (coated at approximately 63% solids in water) is provided in Table 1. Unless otherwise noted, values in these Examples are reported in wt. %.

TABLE 1

Make Coat Formulation

| Material | Weight % (Wet) |
|---|---|
| ARCLIN 65-2024 (65% solids) | 87.7 |
| DUR-O-SET C310 Polyvinyl Acetate (54% solids) | 11.53 |
| Aluminum Chloride (28% solids) | 0.51 |
| TERGITOL 15-S-7 | 0.15 |
| ADVANTAGE AM 1521 | 0.11 |

For coated abrasives sheets on paper, prepared using P220 abrasive particles, the make coating was rolled coated onto a 115 gsm (grams/meter$^2$), "A" weight paper backing having an SBR (styrene butadiene rubber) latex barrier coating. The target coating weight of the make coating was 5.1+/−0.5 grains/24 inch$^2$ (wet weight). The 220 abrasive particles were then electrostatically coated onto the make coating, and the make coating was cured at about 150° F. (66° C.) for 20 minutes. The target coating weight of the abrasive particles was 13.0+/−1.0 grains/24 inch$^2$.

For coated abrasives sheets prepared on paper, using P80 abrasive particles, the make coating was rolled coated onto a 125 gsm, "C" weight paper backing having an SBR (styrene butadiene rubber) latex barrier coating. The target coating weight of the make coating was 11.0+/−2.0 grains/24 inch$^2$ (wet weight). The P80 abrasive particles were then electrostatically coated onto the make coating, and the make coating was cured at about 150° F. (66° C.) for 20 minutes. The target coating weight of the abrasive particles was 37.0+/−2.0 grains/24 inch$^2$.

Anti-Loading Size Composition:

Samples of the make-coated abrasive sheets on paper measuring 12 inches×35 inches (30.5 cm×88.9 cm) were then further coated with an anti-loading size composition using one of the two methods described below. The anti-loading size coating formulations are provided in the Tables and were coated at approximately 65% solids in water.

Method A: The anti-loading size coating was coated on to the make-coated sheet using an Eagle Tool 2-roll gravure coater. The size-coated sheet was cured at about 150° F. (66° C.) for 30 minutes, and then cured at about 180° F. (82° C.) for 3 hours. The cured sheet was orthogonally flexed, laminated on a hook-and-loop fastener and die-cut into 5 inch (12.7 cm) diameter abrasive discs for further testing according to the Abrasion and Anti-loading Test Methods above.

Method B: The make-coated sheet was vertically clipped on to a spray board. The anti-loading size coating was coated on to the make-coated sheet carried out using an automated 3M ACCUSPRAY spray gun with a 3M ACCUSPRAY atomizing head (available from 3M Company, St. Paul, Minn.). The size-coated sheet was cured at about 150° F. (66° C.) for 30 minutes, and then cured at about 180° F. (82° C.) for 3 hours. The cured sheet was orthogonally flexed, laminated on a hook-and-loop fastener and die-cut into 5 inch (12.7 cm) diameter abrasive discs for further testing according to the Abrasion and Anti-loading Test Methods above.

The target wet coating weight of the anti-loading size composition was 17.5+/−1.0 grains/24 inch$^2$ (73.2+/−4.2 gsm) for the 220 coated abrasive sheets. The target wet coating weight of the anti-loading size coating was 37.0+/−2.0 grains/24 inch$^2$ (154.8+/−8.4 gsm) for the 80 coated abrasive sheets.

Preparation of Abrasive Substrates—Saturant & Primer Compositions (E50-74)

Preparation of PET SCOTCH BRITE PAD

An air laid nonwoven pad, having a weight of 2.8 Gram/24 $in^2$, was prepared from the mix of 75% of 15 denier polyester fiber and 25% of MELTY fiber using an air Rando Weber machine (commercially available from the Rando machine Company, Macedon, N.Y.). The thickness of the nonwoven pad was 0.5 cm.

Treatment of PET Fiber Substrate Samples with Saturants (Substrate AA)

An unprimed PET Film was secured to a glass substrate. A PET Spunbond Fiber Backing was then submerged in each of the saturant compositions (described in Table 14 for Examples E50-E58) for 5 seconds, followed by removal and drainage for another 5 seconds. The saturated backing was then placed on the PET Film, and held in place while a Mayer rod #20 was used to remove excess saturant composition from the PET Spunbond Fiber Backing. The saturated PET Spunbond Fiber Backing was then dried and cured at 130° C. for 5 minutes.

Treatment of PET Scotch Brite Composite Samples with Saturants (Substrate BB)

The saturant solution (described in Table 14 for Examples E68-E74) was applied via a 2-roll coater for a wet add-on weight of 4 gram/24 int. The saturated pad was cured to a non-tacky condition by passing the coated web through a convection oven at 130° C. for 5 minutes, yielding a prebonded substrate.

Treatment of PET Film with Primers (Substrate CC)

An unprimed PET Film was rolled coated with saturant/primer composition (described in Table 14 for Examples E68-E74) using a Mayer rod #3.5, and then dried and cured at 130° C. for 5 minutes.

Examples E1-E6

Abrasive discs were prepared with P220 abrasive particles and urea-formaldehyde/wax based anti-loading size composition formulations according to the methods described above. Abrasive discs without any wax were also prepared as controls. Examples E5 and E6 included an EVA emulsion having a Tg of 11° C. as the wax compatible latex. Cut and cut durability data were obtained using the Abrasion Test described above. After testing the discs were examined for their anti-loading properties according to the Anti-loading Test described above. The anti-loading size composition formulations and test results are provided in Table 2.

TABLE 2

Formulations and Performance for Examples E1-E6 and Controls 1-3

| Example | E1 | E2 | E3 | E4 | E5 | E6 | Control1 | Control2 | Control3 |
|---|---|---|---|---|---|---|---|---|---|
| ARCLIN 65-2024 | 88.20 | 73.20 | 72.70 | 67.70 | 67.70 | 88.20 | 98.20 | 78.20 | 77.70 |
| TUFCOR 1214 | — | — | — | — | 5.00 | 5.00 | — | — | — |
| TUFCOR 1063 | — | — | — | — | — | — | — | — | — |
| AQUACER 531 | 10.00 | 5.00 | 5.00 | 5.00 | 5.00 | 5.00 | — | — | — |
| AQUACER 494 | — | — | — | 5.00 | — | — | — | — | — |
| MINEX 10 | — | 20.00 | 20.00 | 20.00 | 20.00 | — | — | 20.00 | 20.00 |
| COATOSIL MP 200 | — | — | 0.50 | 0.50 | 0.50 | — | — | — | 0.50 |
| ADVANTAGE AM1512A | 0.24 | 0.24 | 0.24 | 0.24 | 0.24 | 0.24 | 0.24 | 0.24 | 0.24 |
| AMMONIUM CHLORIDE | 1.35 | 1.35 | 1.35 | 1.35 | 1.35 | 1.35 | 1.35 | 1.35 | 1.35 |
| ALUMINUM CHLORIDE | 0.21 | 0.21 | 0.21 | 0.21 | 0.21 | 0.21 | 0.21 | 0.21 | 0.21 |
| Coating Method | B | B | B | B | B | B | B | B | B |
| Total Cut (grams) | 10 | 10 | 8 | 8 | 12 | 11 | 7 | 7 | 8 |
| Cut Durability (%) | 55 | 72 | 65 | 49 | 62 | 72 | 47 | 59 | 62 |
| Anti-loading Ranking | 4 | 3 | 3 | 2 | 4 | 4 | 1 | 1 | 1 |

Examples E7-E15

Abrasive discs were prepared with P220 abrasive particles and urea-formaldehyde/wax based anti-loading size coating formulations according to the methods described above. The wax compatible latex used in the formulations was PVA emulsion having a Tg of 10° C. A comparative example having a calcium stearate-based size coating was also evaluated. Cut and cut durability data were obtained using the Abrasion Test described above. After testing the discs were examined for their anti-loading properties according to the Anti-loading Test described above. The anti-loading size composition formulations and test results are provided in Table 3.

TABLE 3

Formulation and Performance for Examples E7-E15 and Comparative 1

| Example | E7 | E8 | E9 | E10 | E11 | E12 | E13 | E14 | E15 | CE1 |
|---|---|---|---|---|---|---|---|---|---|---|
| ARCLIN 65-2024 | 88.20 | 68.20 | 67.70 | 67.70 | 67.70 | 88.20 | 63.20 | 63.20 | 63.20 | 67.70 |
| TUFCOR 5750 | 5.00 | 5.00 | 5.00 | 5.00 | 5.00 | 10.00 | 10.00 | 10.00 | 10.00 | — |
| AQUACER 531 | 5.00 | 5.00 | 5.00 | — | — | — | 5.00 | — | — | 5.00 |
| AQUACER 494 | — | — | — | 5.00 | — | — | — | 5.00 | — | — |
| LANCO GLIDD 6148 | — | — | — | — | 5.00 | — | — | — | 5.00 | — |
| CALCIUM STEARATE | — | — | — | — | — | — | — | — | — | 5.00 |
| MINEX 10 | — | 20.00 | 20.00 | 20.00 | 20.00 | — | 20.00 | 20.00 | 20.00 | 20.00 |
| COATOSIL MP 200 | — | — | 0.50 | 0.50 | 0.50 | — | — | — | — | 0.50 |
| ADVANTAGE AM1512A | 0.24 | 0.24 | 0.24 | 0.24 | 0.24 | 0.24 | 0.24 | 0.24 | 0.24 | 0.24 |
| AMMONIUM CHLORIDE | 1.35 | 1.35 | 1.35 | 1.35 | 1.35 | 1.35 | 1.35 | 1.35 | 1.35 | 1.35 |
| ALUMINUM CHLORIDE | 0.21 | 0.21 | 0.21 | 0.21 | 0.21 | 0.21 | 0.21 | 0.21 | 0.21 | 0.21 |
| Coating Method | B | B | B | B | B | B | B | B | B | B |
| Total Cut (grams) | 11 | 11 | 11 | 12 | 11 | 9 | 7 | 7 | 9 | 7 |
| Cut Durability (%) | 81 | 88 | 95 | 88 | 85 | 64 | 48 | 41 | 47 | 52 |
| Anti-loading Ranking | 4 | 5 | 5 | 4 | 4 | 3 | 2 | 2 | 3 | 3 |

Examples E16-E24

Abrasive discs were prepared with P220 abrasive particles and urea-formaldehyde/wax based anti-loading size composition formulations according to the methods described above. The wax compatible latex used in the formulations was PVA emulsion having a Tg of 20° C. Cut and cut durability data were obtained using the Abrasion Test described above. After testing the discs were examined for their anti-loading properties according to the Anti-loading Test described above. The anti-loading size composition formulations and test results are provided in Table 4.

TABLE 4

Formulation and Performance for Examples E16-E24

| Example | E16 | E17 | E18 | E19 | E20 | E21 | E22 | E23 | E24 |
|---|---|---|---|---|---|---|---|---|---|
| ARCLIN 65-2024 | 88.20 | 68.20 | 67.70 | 67.70 | 67.70 | 67.70 | 63.20 | 63.20 | 63.20 |
| TUFCOR 1063 | 5.00 | 5.00 | 5.00 | 5.00 | 5.00 | 5.00 | 10.00 | 10.00 | 10.00 |
| AQUACER 531 | 5.00 | 5.00 | 5.00 | — | — | — | 5.00 | — | — |
| AQUACER 494 | — | — | — | 5.00 | — | — | — | 5.00 | — |
| LANCO GLIDD 6148 | — | — | — | — | 5.00 | — | — | — | 5.00 |
| MP-28C | — | — | — | — | — | 5.00 | — | — | — |
| MINEX 10 | — | 20.00 | 20.00 | 20.00 | 20.00 | 20.00 | 20.00 | 20.00 | 20.00 |
| COATOSIL MP 200 | — | — | 0.50 | 0.50 | 0.50 | 0.50 | — | — | — |
| ADVANTAGE AM1512A | 0.24 | 0.24 | 0.24 | 0.24 | 0.24 | 0.24 | 0.24 | 0.24 | 0.24 |
| AMMONIUM CHLORIDE | 1.35 | 1.35 | 1.35 | 1.35 | 1.35 | 1.35 | 1.35 | 1.35 | 1.35 |
| ALUMINUM CHLORIDE | 0.21 | 0.21 | 0.21 | 0.21 | 0.21 | 0.21 | 0.21 | 0.21 | 0.21 |
| Coating Method | B | B | B | B | B | B | B | B | B |
| Total Cut (grams) | 11 | 11 | 12 | 11 | 11 | 7 | 8 | 6 | 8 |
| Cut Durability (%) | 69 | 92 | 59 | 85 | 82 | 42 | 48 | 49 | 44 |
| Anti-loading Ranking | 2 | 4 | 4 | 3 | 4 | 1 | 2 | 1 | 3 |

Examples E25-E27

Abrasive discs were prepared with P220 abrasive particles and urea-formaldehyde/wax based anti-loading size composition formulations according to the methods described above. The wax compatible latex used in the formulations was PVA emulsion having a Tg of 30° C. A control without any wax was also evaluated. Cut and cut durability data were obtained using the Abrasion Test described above. After testing the discs were examined for their anti-loading properties according to the Anti-loading Test described above.

The anti-loading size composition formulations and test results are provided in Table 5.

TABLE 5

Formulation and Performance for Examples E25-E27

| Example | E25 | E26 | E27 |
|---|---|---|---|
| ARCLIN 65-2024 | 67.70 | 88.20 | 88.20 |
| TUFCOR 3025 | 5.00 | 5.00 | 10.00 |
| AQUACER 531 | 5.00 | 5.00 | — |
| MINEX 10 | 20.00 | — | — |
| COATOSIL MP 200 | 0.5 | — | — |
| ADVANTAGE AM1512A | 0.24 | 0.24 | 0.24 |
| AMMONIUM CHLORIDE | 1.35 | 1.35 | 1.35 |
| ALUMINUM CHLORIDE | 0.21 | 0.21 | 0.21 |
| Coating Method | B | B | B |
| Total Cut (grams) | 11 | 11 | 9 |
| Cut Durability (%) | 72 | 67 | 57 |
| Anti-loading Ranking | 3 | 3 | 2 |

Examples E28-E33

Abrasive discs were prepared with P220 abrasive particles and urea-formaldehyde/wax based anti-loading size composition formulations according to the methods described above. The wax compatible latexes used in the formulations were acrylic emulsions having Tgs of −3° C., 19° C., and 35° C. Cut and cut durability data were obtained using the Abrasion Test described above. After testing the discs were examined for their anti-loading properties according to the Anti-loading Test described above. The anti-loading size composition formulations and test results are provided in Table 6.

TABLE 6

Formulation and Performance for Examples E28-E33

| Example | E28 | E29 | E30 | E31 | E32 | E33 |
|---|---|---|---|---|---|---|
| ARCLIN 65-2024 | 68.20 | 67.70 | 67.70 | 67.70 | 67.70 | 88.20 |
| HYCAR 2679 | 5.00 | 5.00 | 5.00 | 5.00 | — | — |

TABLE 6-continued

Formulation and Performance for Examples E28-E33

| Example | E28 | E29 | E30 | E31 | E32 | E33 |
|---|---|---|---|---|---|---|
| RHOPLEX HA-12 | — | — | — | — | 5.00 | — |
| RHOPLEX HA-16 | — | — | — | — | — | 5.00 |
| AQUACER 531 | 5.00 | — | 5.00 | — | 5.00 | 5.00 |
| AQUACER 494 | — | 5.00 | — | — | — | — |
| LANCO GLIDD 6148 | — | — | — | 5.00 | — | — |
| MINEX 10 | 20.00 | 20.00 | 20.00 | 20.00 | 20.00 | — |
| COATOSIL MP 200 | — | 0.50 | 0.50 | 0.50 | 0.50 | — |
| ADVANTAGE AM1512A | 0.24 | 0.24 | 0.24 | 0.24 | 0.24 | 0.24 |
| AMMONIUM CHLORIDE | 1.35 | 1.35 | 1.35 | 1.35 | 1.35 | 1.35 |
| ALUMINUM CHLORIDE | 0.21 | 0.21 | 0.21 | 0.21 | 0.21 | 0.21 |
| Coating Method | B | B | B | B | B | B |
| Total Cut (grams) | 12 | 10 | 12 | 7 | 10 | 11 |
| Cut Durability (%) | 74 | 71 | 79 | 51 | 78 | 61 |
| Anti-loading Ranking | 2 | 2 | 3 | 1 | 4 | 3 |

Examples E34-E42

Abrasive discs were prepared with P220 abrasive particles and phenol-formaldehyde/wax based anti-loading size composition formulations according to the methods described above. Various waxes and wax compatible latexes were evaluated. Cut and cut durability data were obtained using the Abrasion Test described above. Anti-loading ranking was not done after abrasion testing because all the discs appeared to be visually acceptable. The anti-loading size composition formulations and test results are provided in Table 7.

TABLE 7

Formulation and Performance for Examples E34-E42

| Example | E34 | E35 | E36 | E37 | E38 | E39 | E40 | E41 | E42 |
|---|---|---|---|---|---|---|---|---|---|
| ARCLIN 65-2024 | 98.20 | 77.70 | 72.70 | 72.70 | 72.70 | 67.70 | 67.70 | 67.70 | 67.70 |
| TUFCOR 5750 | — | — | — | — | — | 5.00 | — | — | — |
| ROVENE 4002 | — | — | — | — | — | — | 5.00 | — | — |
| HYCAR 2679 | — | — | — | — | — | — | — | 5.00 | — |
| ALBERDINGK U 9700 | — | — | — | — | — | — | — | — | 5.00 |
| AQUACER 531 | — | — | — | 5.00 | — | 5.00 | — | 5.00 | 5.00 |
| AQUACER 494 | — | — | — | — | — | — | — | — | — |
| LANCO GLIDD 6148 | — | — | 5.00 | — | — | — | 5.00 | — | — |
| AQUASLIP 671 | — | — | — | — | 5.00 | — | — | — | — |
| MINEX 10 | — | 20.00 | 20.00 | 20.00 | 20.00 | 20.00 | 20.00 | 20.00 | 20.00 |
| COATOSIL MP 200 | — | 0.50 | 0.50 | 0.50 | 0.50 | 0.50 | 0.50 | 0.50 | 0.50 |
| ADVANTAGE AM1512A | 0.24 | 0.24 | 0.24 | 0.24 | 0.24 | 0.24 | 0.24 | 0.24 | 0.24 |
| AMMONIUM CHLORIDE | 1.35 | 1.35 | 1.35 | 1.35 | 1.35 | 1.35 | 1.35 | 1.35 | 1.35 |
| ALUMINUM CHLORIDE | 0.21 | 0.21 | 0.21 | 0.21 | 0.21 | 0.21 | 0.21 | 0.21 | 0.21 |
| Coating Method | A | A | A | A | A | A | A | A | A |
| Total Cut (grams) | 37 | 46 | 68 | 70 | 67 | 69 | 60 | 64 | 73 |
| Cut Durability (%) | 60 | 66 | 78 | 79 | 76 | 84 | 59 | 77 | 85 |
| Anti-loading Ranking | NT | NT | NT | NT | NT | NT | NT | NT | NT |

Examples E43-E46

Abrasive discs were prepared with both P80 and P220 abrasive particles and phenol-formaldehyde/wax based anti-loading size composition formulations according to the methods described above. The wax compatible latex used was an acrylic emulsion having a Tg of −3° C. Cut and cut durability data were obtained using the Abrasion Test described above. After testing the P220 abrasive discs were examined for their anti-loading properties according to the Anti-loading Test described above. Anti-loading ranking was not done after abrasion testing for the P80 abrasive discs because all the discs appeared to be visually acceptable. The anti-loading size composition formulations and test results are provided in Table 8.

TABLE 8

Formulation and Performance for Examples E43-E46 and Controls 4 & 5

| | Example | | | | | |
|---|---|---|---|---|---|---|
| | Control4 (P220) | E43 (P220) | E44 (P220) | Control5 (P80) | E45 (P80) | E46 (P80) |
| PF RESIN | 79.26 | 74.26 | 69.26 | 79.26 | 74.26 | 69.26 |
| HYCAR 2679 | — | — | 5.00 | — | — | 5.00 |
| AQUACER 531 | — | 5.00 | 5.00 | — | 5.00 | 5.00 |
| MINEX 10 | 20.00 | 20.00 | 20.00 | 20.00 | 20.00 | 20.00 |
| COATOSIL MP 200 | 0.5 | 0.50 | 0.50 | 0.5 | 0.50 | 0.50 |
| ADVANTAGE AM1512A | 0.24 | 0.24 | 0.24 | 0.24 | 0.24 | 0.24 |
| Coating Method | B | B | B | B | B | B |
| Total Cut (grams) | 9 | 11 | 13 | 73 | 75 | 80 |
| Cut Durability (%) | 73 | 89 | 95 | 114 | 111 | 109 |
| Anti-loading Ranking | 3 | 4 | 4 | NT* | NT | NT |

*NT = not tested

Examples E47-E48

Abrasive discs were prepared with P220 abrasive particles and urea-formaldehyde/wax based anti-loading size composition formulations according to the methods described above. The wax compatible latexes used in the formulations were a crosslinkable vinyl acetate copolymer and a crosslinkable hydroxyethyl cellulose. Cut and cut durability data were obtained using the Abrasion Test described above. After testing the discs were examined for their anti-loading properties according to the Anti-loading Test described above. The anti-loading size composition formulations and test results are provided in Table 9.

TABLE 9

Formulations and Performance for Examples E47-48

| Example | E47 | E48 |
|---|---|---|
| ARCLIN 65-2024 | 88.20 | 73.20 |
| AQUACER 531 | 5.00 | 5.00 |
| MINEX 10 | 20.00 | 20.00 |
| COATOSIL MP 200 | 0.5 | 0.5 |
| X-LINK 2712 | 5.0 | 0.0 |
| CELLOSIZE HEC | 0.0 | 5.0 |
| ADVANTAGE AM1512A | 0.24 | 0.24 |
| AMMONIUM CHLORIDE | 1.35 | 1.35 |
| ALUMINUM CHLORIDE | 0.21 | 0.21 |
| Coating Method | B | B |
| Total Cut (grams) | 12 | 11 |
| Cut Durability (%) | 83 | 64 |
| Anti-loading Ranking | 5 | 4 |

Example 49

Abrasive discs were prepared with P220 abrasive particles and a second urea-formaldehyde/wax based anti-loading size composition formulation, Make Coating 2, according to the methods described above. The wax compatible latex used in the formulations was PVA emulsion having a Tg of 20° C. Cut and cut durability data were obtained using the Abrasion Test described above. After testing the discs were examined for their anti-loading properties according to the Anti-loading Test described above. The anti-loading size composition formulations and test results are provided in Table 11.

Make Coating 2:

The formulation of the make coating for Examples 49 (coated at approximately 63% solids in water) is provided in Table 10.

TABLE 10

Make Coat Formulation

| Material | Weight % (Wet) |
|---|---|
| DURITE AL 3029c (65% solids) | 90.44 |
| DUR-O-SET C310 Polyvinyl Acetate (54% solids) | 11.53 |
| HYCAR 2679 (50% solids) | 3.19 |
| Aluminum Chloride (28% solids) | 0.30 |
| TERGITOL 15-S-7 | 0.15 |
| ADVANTAGE AM 1521 | 0.11 |

TABLE 11

Formulation and Performance for Example E49

| Example | E16 |
|---|---|
| DURITE AL 3029c | 88.20 |
| TUFCOR 1063 | 5.00 |
| AQUACER 531 | 5.00 |
| MINEX 10 | 20.0 |
| COATOSIL MP 200 | 0.5 |
| ADVANTAGE AM1512A | 0.24 |
| AMMONIUM CHLORIDE | 1.35 |
| ALUMINUM CHLORIDE | 0.21 |
| Coating Method | B |
| Total Cut (grams) | 11 |
| Cut Durability (%) | 67 |
| Anti-loading Ranking | 4 |

Examples E50-E76

Saturated backings were prepared with urea formaldehyde saturants/primers according to the methods described above.

Coated Abrasive Preparation for Substrates AA & CC

The coated substrates, PET Fiber Substrate Samples with Saturants (Substrate AA) and Treatment of PET Film with Primers (Substrate CC), were coated with the Table 1 Make Coat Formulation. For coated abrasives sheets prepared using P80 abrasive particles, the make coating was rolled coated onto the AA or CC substrate. The target coating weight of the make coating was 0.7 gram/24 inch$^2$ (wet weight). The P80 abrasive particles were then electrostatically coated onto the make coating, and the make coating was cured at about 150° F. (66° C.) for 20 minutes. The target coating weight of the abrasive particles was 2.4 gram/24 inch$^2$. For coated abrasives sheets prepared using P120 abrasive particles, the target coating weight of the make coating was 0.5 gram/24 inch$^2$ (wet weight), and the target coating weight of the abrasive particles was 1.8 gram/24 inch$^2$. For coated abrasives sheets prepared using P150 abrasive particles, the target coating weight of the make coating was 0.4 gram/24 inch$^2$ (wet weight), and the target coating weight of the abrasive particles was 1.6 gram/24 inch$^2$.

The AA and CC articles with make coats were then coated using Method A. above, using the Anti-loading size coat of Table 12 below for Examples E50-E76, or the Standard size coat of Table 13 below for Controls 4 (AA substrate), and 6 (CC Substrate). For P80 abrasive particles, the anti-loading size coat coating weight was about 2.6 gram/24 inch$^2$, for P120 abrasive particles, the anti-loading size coat coating weight was about 1.6/24 inch$^2$, for P150 abrasive particles, the anti-loading size coat coating weight was about 1.0/24 inch$^2$.

Coated Abrasive Preparation for Substrate BB.

The surface of the saturated web was spray coated at a line speed of 5 feet/min. (1.5 m/min) with a resin/abrasive slurry (formulation in Table 12 below) using a spray gun ("BINKS SPRAY GUN #601") equipped with nozzle #59ASS and cap #151 (all obtained from Midway Industrial Supply Co., St. Paul, Minn.). The spray was delivered to the spray gun utilizing a Bredel Hose Pump SP/15 (obtained from Powell Equipment Sales, Inc., Coon Rapids, Minn.). The spray gun was reciprocated across the web at 61 reciprocations per minute to provide a wet add-on weight of 4.9/3.2/2.1 Gram/24 in$^2$ for 80/150/120 grit.

The resulting spray coated web was dried in a 20 ft (6.1 m) long forced air convection oven at 320° F.

(160° C.), with a residence time of about 5 minutes.

TABLE 12

Formulation of Spray Slurry

| Spray Slurry Material | Weight % (Wet) |
|---|---|
| Phenolic BB-077 (75%) | 25 |
| Sun Green CGD-9957 | 1 |
| Hubercarb Q325 | 8.45 |
| Water | 5.55 |
| Mineral (80 grit, 120 grit or 150 grit) | 60 |

Adhesion data were obtained using the Cross Hatch and Shelling Tests described above. The saturant formulations and adhesion test results for substrates having P80 abrasive make coats and anti-loading size coats are provided in Tables 14 & 15 below. Examples E50-58 are on Substrate AA, E59-E67 are on Substrate BB, and E68-E76 are on Substrate CC.

TABLE 13

Anti-loading size coat formulation for Examples E50-E58 and E68-E76

| Anti-loading size coat | % solid | Solution g |
|---|---|---|
| Arclin UF Resin 3029C | 65% | 68.50 |
| anti-foamer 1512 | 100% | 0.15 |
| Minex10 | 100% | 13.25 |
| Water | | 5.15 |
| X-link 2712 | 55% | 6.02 |
| Aquacer 531 | 45% | 7.36 |
| Silane A187 | 100% | 0.67 |
| NH4C1 | 25% | 3.57 |
| Aluminium Chloride Solution (28%)(AlCl3) | 28% | 0.50 |

TABLE 14

Standard Size Coat
Wt. % solid is 63%

| Standard Size Coat | g solution |
|---|---|
| ARCLIN UF 65-2024 (65% solid) | 93.07 g |
| TERGITOL 15-S-7 | 0.07 g |
| ADVANTAGE AM1512 Defoamer | 0.15 g |
| NH4C1 (25% solid) | 4.84 g |
| Aluminium Chloride Solution (28%)(AlCl3) | 0.67 g |

TABLE 15

Formulations and Adhesion Performance for Examples E50-E76

| | Example | | | | | | | | |
|---|---|---|---|---|---|---|---|---|---|
| | E50 E59 E68 | E51 E60 E69 | E52 E61 E70 | E53 E62 E71 | E54 E63 E72 | E55 E64 E73 | E56 E65 E74 | E57 E66 E75 | E58 E67 E76 |
| ARCLIN 65-2024 (65% solids) | 94.27 | 69.38 | 43.30 | 53.31 | 53.26 | 53.18 | 53.31 | 53.26 | 53.18 |
| HYCAR 2679 (50% solids) | 0.00 | 30.07 | 56.3 | 46.44 | 46.42 | 46.40 | 0.00 | 0.00 | 0.00 |
| Rovene5900 | 0.00 | 0.00 | 0.00 | 0.00 | 0.00 | 0.00 | 46.44 | 46.42 | 46.4 |
| TERGITOL 15-S-7 | 0.07 | 0.00 | 0.00 | 0.15 | 0.15 | 0.15 | 0.15 | 0.15 | 0.15 |
| Aluminum Chloride (28% solids) | 0.67 | 0.4 | 0.25 | 0.00 | 0.00 | 0.00 | 0.00 | 0.00 | 0.00 |
| ADVANTAGE AM 1521 | 0.15 | 0.15 | 0.15 | 0.00 | 0.00 | 0.00 | 0.00 | 0.00 | 0.00 |

TABLE 15-continued

Formulations and Adhesion Performance for Examples E50-E76

| | Example | | | | | | | | |
|---|---|---|---|---|---|---|---|---|---|
| | E50 E59 E68 | E51 E60 E69 | E52 E61 E70 | E53 E62 E71 | E54 E63 E72 | E55 E64 E73 | E56 E65 E74 | E57 E66 E75 | E58 E67 E76 |
| AMMONIUM CHLORIDE (25% solids) | 4.84 | 0.00 | 0.00 | 0.10 | 0.17 | 0.27 | 0.10 | 0.17 | 0.27 |
| Shelling Test - Substrate AA (E50-58) | 1 | 2 | 5 | 5 | 5 | 5 | 5 | 5 | 5 |
| Shelling Test - Substrate BB (E59-E67) | 1 | 2 | 5 | 5 | 5 | 5 | 5 | 5 | 5 |
| Cross Hatch - Substrate CC (E68-E76) | 0B | 2B | 5B | 4B | 4B | 4B | 4B | 4B | 4B |
| Shelling Test- Substrate CC (E68-E76) | 1 | 2 | 5 | 5 | 5 | 5 | 5 | 5 | 5 |

TABLE 16

Performance for Control 4-6 on substrates AA, BB and CC

| Example | Control 4 (AA) | Control 5 (BB) | Control 6 (CC) |
|---|---|---|---|
| Cross Hatch Adhesion | NA 5 | NA 5 | 5B 5 |

NA = not applicable

TABLE 17

Performance for Control 4 and E53

| | Control 4 P80 | Control 4 P120 | Control 4 P150 | E53 P80 | E53 P120 | E53 P150 |
|---|---|---|---|---|---|---|
| Total Cut | 43 g | 24 | 16 | 77 g | 31 | 22 |
| Anti-loading Ranking | 1 | 1 | 1 | 4 | 4 | 4 |
| Cut durability final cut/initial cut | 58% | 47% | 41% | 76% | 64% | 67% |

TABLE 18

Performance for Control 6 and E70

| | Control 6 P80 | Control 6 P120 | Control 6 P150 | E53 P80 | E53 P120 | E53 P150 |
|---|---|---|---|---|---|---|
| Total Cut | 38 | 21 | 15 | 69 | 30 | 21 |
| Anti-loading Ranking | 1 | 1 | 1 | 4 | 4 | 4 |
| Cut durability final cut/initial cut | 59% | 45% | 42% | 75% | 59% | 62% |

The recitation of all numerical ranges by endpoint is meant to include all numbers subsumed within the range (i.e., the range 1 to 10 includes, for example, 1, 1.5, 3.33, and 10).

The patents, patent documents, and patent applications cited herein are incorporated by reference in their entirety as if each were individually incorporated by reference. It will be apparent to those of ordinary skill in the art that various changes and modifications may be made without deviating from the inventing concepts set from above. Thus, the scope of the present disclosure should not be limited to the structures described herein. Those having skill in the art will appreciate that many changes may be made to the details of the above-described embodiments and implementations without departing from the underlying principles thereof. Further, various modifications and alterations of the present disclosure will become apparent to those skilled in the art without departing from the spirit and scope of the invention.

The scope of the present application should, therefore, be determined only by the following claims and equivalents thereof.

We claim:

1. An abrasive article comprising:

a backing comprising a first major surface and an opposing second major surface, and the backing further comprising a nonwoven material and a saturant contained in the nonwoven material, wherein the saturant includes a binder resin comprising at least one of a phenolic resin, acrylic, urea resin, and a combination thereof;

an abrasive layer bonded to at least a portion of the first major surface, the abrasive layer comprising abrasive particles retained in a make layer; and an anti-loading size layer at least partially disposed on the abrasive layer and comprising a cured size precursor, wherein the size precursor comprises a urea formaldehyde size binder and modified polyethylene wax at a concentration of no greater than about 20 percent by weight of the precursor.

2. The abrasive article of claim 1, wherein the size binder is present in the precursor at a concentration of at least 40% by weight, based on the total weight of the precursor.

3. The abrasive article of claim 1, wherein the wax has a wax melting point onset greater than 100 degrees Celsius.

4. The abrasive article of claim 1, wherein the anti-loading size layer further comprises a wax compatible latex, and wherein the wax compatible latex is selected from the group consisting of natural rubber, butadiene rubber, styrene-butadiene rubber, styrene-butadiene-acrylonitrile rubber, chloroprene rubber and methyl-butadiene rubber, cellulose and acrylic and vinyl acetate emulsions.

5. The abrasive article of claim 4, wherein the latex has a T(g) of between about 5° C. and about 50° C.

6. The abrasive article of claim 1 wherein the saturant includes a urea formaldehyde resin.

7. The abrasive article of claim 1 wherein the saturant includes a urea formaldehyde resin and a compatible latex.

8. The abrasive article of claim 7, wherein the latex is an acrylic emulsion.

9. The abrasive article of claim 1, wherein the wax is selected from the group consisting of paraffin wax, polyethylene wax, carnuba wax, polypropylene wax, Ethylene bis stearamide (EBS) wax, and combinations thereof.

10. The abrasive article of claim 1, wherein the latex is present in the saturant at a concentration of between about 10 percent by weight and about 80 percent by weight, prior to the saturant being incorporated into the backing.

11. The abrasive article of claim 1, wherein the saturant further comprises a saturant latex, wherein a saturant ratio is defined by a ratio of the amount of saturant binder to saturant latex, and wherein the saturant ratio is no greater than 5:1.

12. The abrasive article of claim 1, wherein an outermost layer of the article does not include a stearate.

13. The abrasive article of claim 1, wherein the backing includes a spun bond nonwoven fiber web or an air laid nonwoven fiber web.

14. The abrasive article of claim 13, wherein the nonwoven fiber web includes polyethylene terephthalate fibers.

15. The abrasive article of claim 14, wherein the fibers within the nonwoven fiber web consist essentially of polyethylene terephthalate.

16. An abrasive article comprising:

a backing comprising a first major surface and an opposing second major surface, and the backing further comprising polyethylene and a saturant applied to the polyethylene, wherein the saturant includes a urea resin and a compatible latex;

an abrasive layer bonded to at least a portion of the first major surface, the abrasive layer comprising abrasive particles retained in a make layer; and an anti-loading size layer at least partially disposed on the abrasive layer and comprising a cured size precursor, wherein the size precursor comprises a urea formaldehyde size binder and a modified polyethylene wax at a concentration of no greater than about 20 percent by weight of the precursor.

* * * * *